US006535187B1

(12) United States Patent
Wood

(10) Patent No.: US 6,535,187 B1
(45) Date of Patent: Mar. 18, 2003

(54) METHOD FOR USING A SPATIAL LIGHT MODULATOR

(76) Inventor: Lawson A. Wood, 873 N. Frederick St., Arlington, VA (US) 22205

( * ) Notice: Subject to any disclaimer, the term of this patent is extended or adjusted under 35 U.S.C. 154(b) by 0 days.

(21) Appl. No.: 09/063,364

(22) Filed: Apr. 21, 1998

(51) Int. Cl.[7] ..... G09G 3/36

(52) U.S. Cl. ..... 345/84; 345/32; 345/89; 345/147; 345/204; 345/205; 345/207; 348/742; 348/744; 348/750; 348/755; 348/767; 348/771

(58) Field of Search ..... 345/32, 84, 89, 345/147, 204, 205, 207; 348/744, 742, 755, 767, 771, 750

(56) References Cited

U.S. PATENT DOCUMENTS 3,946,433 A * 3/1976 Kermisch ..... 358/62
4,481,531 A * 11/1984 Warde et al. ..... 348/767
5,096,279 A 3/1992 Hornbeck et al.
5,122,791 A 6/1992 Gibbons et al.
5,231,388 A * 7/1993 Stoltz ..... 345/84
5,280,277 A 1/1994 Hornbeck
5,416,496 A 5/1995 Wood
5,448,314 A 9/1995 Heimbuch et al.
5,452,024 A 9/1995 Sampsell
5,592,188 A * 1/1997 Doherty et al. ..... 345/84
5,668,572 A 9/1997 Meyer et al.
5,706,061 A 1/1998 Marshall et al.
5,738,429 A * 4/1998 Tagawa et al. ..... 353/122
5,748,164 A * 5/1998 Handschy et al. ..... 345/89
5,757,348 A 5/1998 Handschy et al.
5,777,589 A * 7/1998 Gale et al. ..... 345/84
5,812,303 A 9/1998 Hewlett et al. ..... 359/298
5,903,323 A * 5/1999 Ernstoff et al. ..... 345/84
5,909,204 A * 6/1999 Gale et al. ..... 345/84
5,917,558 A 6/1999 Stanton
5,995,071 A * 11/1999 Mertz ..... 345/84
6,002,452 A * 12/1999 Morgan ..... 348/742
6,232,963 B1 5/2001 Tew et al. ..... 345/204

OTHER PUBLICATIONS

Jack M. Younse, "Mirrors On A Chip," *IEEE Spectrum* (Nov. 1993), pp. 27–31.

* cited by examiner

*Primary Examiner*—Bipin Shalwala
*Assistant Examiner*—Vincent E. Kovalick
(74) *Attorney, Agent, or Firm*—Rabin & Berdo

(57) ABSTRACT

Light is shined on an addressable spatial light modulator, and the light is also integrated. The data displayed on the spatial light modulator is changed when the integrated light reaches a predetermined value. The light may impinge on the spatial light modulator through a color wheel, which may be rotated faster than the frame repetition rate of video information that is being displayed. Alternatively, the light may be generated by different-colored lamps. The intensity of the light may be controlled in accordance with the bit rank or significance of the bits that are being displayed by the spatial light modulator. Several techniques for achieving different intensity levels are disclosed.

39 Claims, 18 Drawing Sheets

METHOD FOR USING A SPATIAL LIGHT MODULATOR

CROSS-REFERENCE TO RELATED APPLICATIONS

The present patent application was filed during the pendency of Applicant's earlier application (Ser. No. 08/381,156), which was filed on Jan. 31, 1995. That application (Ser. No. 08/381,156) was filed during the pendency of Applicant's earlier application (Ser. No. 08/034,694), which was filed on Mar. 19, 1993. That application (Ser. No. 08/034,694) was filed during the pendency of Applicant's earlier application (Ser. No. 07/862,313), which was filed on Apr. 2, 1992. That application (Ser. No. 07/862,313) was filed during the pendency of Applicant's earlier application (Ser. No. 07/521,399), which was filed on May 10, 1990. That application (Ser. No. 07/521,399) was filed during the pendency of Applicant's earlier application (Ser. No. 07/396,916), which was filed on Aug. 22, 1989. The disclosures of these prior applications are incorporated herein by reference.

Application Ser. No. 07/521,399 matured into U.S. Pat. No. 5,128,782, which issued on Jul. 7, 1992, and application Ser. No. 08/034,694 matured into U.S. Pat. No. 5,416,496, which issued on May 16, 1995. Application Ser. No. 07/396,916 and application Ser. No. 07/862,313 have been abandoned.

Although at the time of filing the present application, Applicant does not claim the benefit under 35 U.S.C. § 120 of any of the chain of co-pending applications identified above, Applicant reserves the right to claim such benefit if, at any time during the pendency of the present application at the Patent and Trademark Office or thereafter, prior art turns up which makes such a claim for the benefit of an earlier prior date desirable.

BACKGROUND OF THE INVENTION

The present invention is directed to a technique for using a spatial light modulator to display an image and, more particularly, to a technique for using a spatial light modulator having stable pixels to display a color image having gray scale gradations.

A digital micromirror device is a spatial light modulator which employs an array of tiny mirrors, or micromirrors, whose positions can be electrically controlled in order to display an image. This technology has been developed extensively by Larry J. Hornbeck and his colleagues at Texas Instruments, Inc. of Dallas, Tex., and is described by them in a sequence of patents going back more than a decade. These developmental efforts have culminated in a digital micromirror device which includes an array of memory cells and a corresponding array of pivotable micromirrors whose positions are electrostatically adjusted by the contents of the memory cells. As is perhaps best described in U.S. Pat. No. 5,096,279 to Hornbeck et al., the array of pivotable micromirrors that cooperates with the memory cells can be made using integrated circuit fabrication techniques.

As described in the above-identified patent, in U.S. Pat. No. 5,280,277 to Hornbeck, and in an article entitled "Mirrors on a Chip" that was published in the November 1993 issue of IEEE Spectrum at pages 27–31 by Jack M. Younse, a negative biasing voltage is selectively applied to the micromirrors and to landing electrodes fabricated beneath them in order to obtain bi-stable operation of the micromirrors and simultaneous updating of the entire array of micromirrors. Sometimes, the micromirrors get stuck. It is known that this problem can be solved by subjecting the micromirrors to resonant reset pulses which electrostatically dislodge any stuck micromirrors.

It is also known to make a color display using a single digital micromirror device by sequentially exposing it to red, green, and blue light impinging from a single direction. A white lamp and a color wheel can be employed for this purpose. Gray scale gradations can be achieved by exposing a digital micromirror device to light for different time intervals that are determined in accordance with the rank of bits of video information displayed on the digital micromirror device, as disclosed in U.S. Pat. No. 5,452,024. Furthermore, the light shining on the digital micromirror device may be generated by a lamp that is driven by an amplitude modulated driving waveform, as disclosed in U.S. Pat. No. 5,706,061.

Advances have also been made in display devices which employ other types of spatial light modulators. For example, U.S. Pat. No. 5,122,791 to David J. Gibbons et al discloses a ferroelectric liquid crystal display panel (which has bi-stable pixels with a fast response time) as the spatial light modulator. It is selectively back lit by red, green, and blue fluorescent tubes, and the intensity or duration of the backlighting is controlled on the basis of the rank of the bits that are being displayed on the LCD panel.

Applicant's Pat. No. 5,416,496 also employs a ferroelectric LCD that is back-lit with colored lights. The colored light may be generated in flashes whose intensity is controlled on the basis of the rank of the video information bits that are being displayed. Alternatively, instead of flashes of light, the LCD panel may be illuminated by light that is generated steadily, and whose intensity is determined by the rank of the bits that are being displayed. In the latter alternative, the pixels of the panel are turned on in accordance with the video information on a row-by-row basis, and are subsequently turned off in accordance with the same video information, again on a row-by-row basis. As a result, each pixel that is turned on and then turned off receives the same amount of light regardless of its row, so the LLD can be addressed row-by-row with video information while the LCD is being illuminated.

SUMMARY OF THE INVENTION

An object of the invention is to provide a display apparatus which employs an addressable spatial light modulator that is illuminated by a lighting unit whose light output varies in intensity in accordance with the bit rank of video information that is being used to address to the spatial light modulator, with the light output of the lighting unit being monitored in order to determine when to change what is displayed on the spatial light modulator. The video information may be fed to the spatial light modulator on a frame-to-frame basis for each color, or on a row-by-row basis for each color. If the video information is fed to the spatial light modulator on a row-by-row basis, the amount of light received by different rows can be equalized, during display of a particular bit rank of video information for a particular color, by turning the pixels on row-by-row in accordance with the same video information.

Another object of the invention is to provide a display apparatus which employs a spatial light modulator that is illuminated by a lamp unit having a plurality of lamps, with the light intensity being adjusted by turning at least one of the lamps on and off.

Another object is to provide a spatial light modulator that is illuminated by a lamp unit having a single lamp that is driven at different intensities, depending on the bit rank that is being displayed. Instead of a single lamp, a plurality of lamps that are driven in unison may be used. For example, a plurality of lamps may be connected in parallel to supply more light than could be delivered by a single lamp.

A further object of the invention is to provide a spatial light modulator that is illuminated by a lamp unit which emits light with an intensity that is constant, with the intensity being controlled before the light impinges on the spatial light modulator (or after impingement on the spatial light modulator, if preferred) by passing the light through at least one attenuator. The at least one attenuator may be a plurality of rotating attenuators, possibly combined with a color wheel. Alternatively, the at least one attenuator may be a liquid crystal panel having rows that are selectively turned on in accordance with the desired light intensity, or a liquid crystal cell which is pulse-width modulated in accordance with the desired intensity.

A further object of the invention is to provide novel techniques for illuminating a spatial light modulator through a rotating color wheel. If the color wheel is rotated more than one revolution during display of a frame of video information, different bit ranks of the video information can be allocated to different revolutions. Furthermore, the most significant bits can be partially displayed during one revolution and subsequently completed during one or more additional revolutions.

A still further object of the invention is to integrate the light emitted by a lighting unit whose intensity is changed through a plurality of levels in order to control the duration of buffer periods which accommodate relatively slow changes in the light intensity or erratic light output during transitions from one level to another, the buffer periods being periods when the data displayed on the spatial light modulator is such that all of the pixels of the spatial light modulator are turned off. The buffer periods may have durations that are controlled by monitoring the light generated by the lighting unit. The buffer periods may also have fixed durations, corresponding in duration to the time needed for a color wheel to rotate completely through one or more colored sectors or through one or more complete revolutions.

In accordance with one aspect of the invention, a method for using a spatial light modulator can be conducted by displaying data on the spatial light modulator, shining light on the spatial light modulator, integrating the light, and changing the data displayed on the spatial light modulator when the integrated light reaches a predetermined value. The method may further include changing the intensity of the light shined on the spatial light modulator, either by using a lighting unit having a plurality of lamps and turning at least one of the lamps on and off, or by using a lighting unit having a single lamp that is driven at different energy levels during a sequence of time periods. This latter alternative may be modified by driving a plurality of lamps, in unison, at different energy levels during the sequence of time periods.

A color wheel may be used to color the light, preferably (but not necessarily) before it impinges on the spatial light modulator. The color wheel may be rotated at a rate faster than the frame repetition rate. This can lead to several advantages. One is that some of the bit ranks for all three primary colors can be displayed during one revolution of the color wheel, and other bit ranks can be displayed during one or more subsequent revolutions. Buffer periods can be used to adjust the amount of illumination received by the spatial light modulator in accordance with the bit ranks. Another advantage is that the display of the most significant bits for a frame may be spread over two, and possibly more, revolutions of the color wheel. This means that the total amount of light of a particular color that impinges on the spatial light modulator is not limited by the product of the light intensity and the time needed for the color wheel to rotate through a single colored sector. For example, the spatial light modulator may be illuminated with red light during display of the most significant bits of the red component of an image for a period corresponding to the rotation of the color wheel through an angle of 200°, with half of this angle plus a buffer period occurring during one revolution, and the other half plus another buffer period occurring during another revolution. Illumination for the green and blue components can, of course, also be conducted in this manner. A further advantage is that buffer periods, when all of the pixels are off, may be inserted during rotation of the color wheel through one or more colored sectors or through one or more complete rotations to absorb slow or turbulent transitions from one light-intensity level to another.

According to a related aspect of the invention, a method for using a spatial light modulator can be conducted by displaying data on the spatial light modulator, shining light on the spatial light modulator, coloring the light with a color wheel (preferably before the light impinges on the spatial light modulator, but possibly after impingement of the light instead), and rotating the color wheel faster than the frame repetition rate. The method may further include integrating the light and changing at least some of the data displayed on the spatial light modulator when the integrated light reaches a predetermined value. The most significant bits for all three primary colors may be displayed during two or more revolutions of the color wheel, and different bit ranks for all three primary colors may be displayed during different revolutions. Furthermore, the intensity of the light shined on the spatial light modulator may be changed as the color wheel is rotated.

BRIEF DESCRIPTION OF THE DRAWINGS

FIG. 14 illustrates a lighting unit in which the lamp unit has only one lamp, rather than two lamps as in FIG. 1.

DESCRIPTION OF THE PREFERRED EMBODIMENTS

Various embodiments of a display apparatus in accordance with the present invention will now be described in detail with reference to the accompanying drawings.

The First Embodiment

Figure 1:
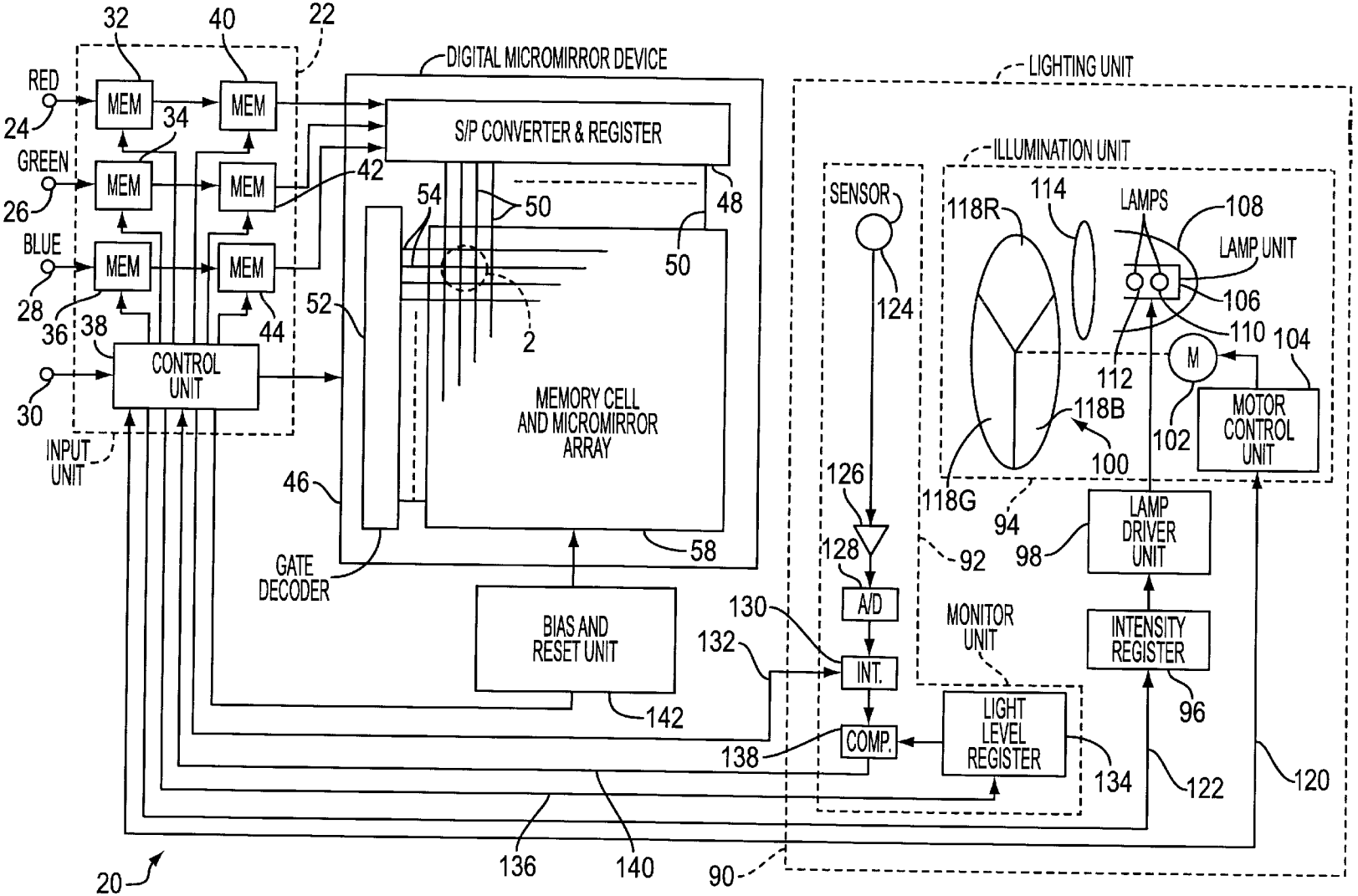
FIG. 1 is a block diagram illustrating the construction of a display apparatus that can be used to carry out a first embodiment of the method of the present invention.

With initial reference to FIG. 1, a display apparatus 20 in accordance with the first embodiment includes an input unit 22 having an input terminal 24 for receiving a digitized signal for the red component of an image, an input terminal 26 for receiving a digitized signal for the green component, an input terminal 28 for receiving a digitized signal for the blue component, and an input terminal 30 for receiving synchronization signals. The digitized signals for the red, green, and blue components consist of multi-bit video data words (hereafter usually referred to as "video words"), each specifying one of a plurality of binary levels for the red, green, or blue intensity of a corresponding pixel that is to be displayed. The video words for the red, green, and blue components are stored in respective frame memories 32, 34, and 36 under the control of a control unit 38, which includes a microprocessor. When a full frame is stored, control unit 38 transfers the contents of memories 32–36 to further frame memories 40, 42, and 44, and then begins storing the next frame in memories 32–36. Control unit 38 also reads out the contents of memories 40–44 to a display unit having an addressable spatial light modulator with an array of bi-stable (that is, either on or off) pixels. In this embodiment, the display unit is a digital micromirror device 46 (hereafter usually referred to as "DMD 46").

DMD 46 is basically an integrated circuit having an array of static random access memory cells, addressing means for storing data in the cells, and tiny movable mirrors or micromirrors which cooperate with the memory cells. It will be described in more detail with reference to FIGS. 1–3.

The addressing means for DMD 46 includes a serial/parallel converter and register 48 which receives a series of bits as input data and adjusts the voltages on column conductors 50 in accordance with the input data. The addressing means also includes a gate decoder 52 which strobes row electrodes 54 in sequence. Each time a row electrode is strobed, the data on the column electrodes 50 are stored in a row of static memory cells corresponding to the row electrode. A micromirror 56 is disposed above each memory cell and serves as a pixel that is controlled by the memory cell. The memory cells and micromirrors together form an array which is designated by reference number 58 in FIG. 1.

Figure 2:
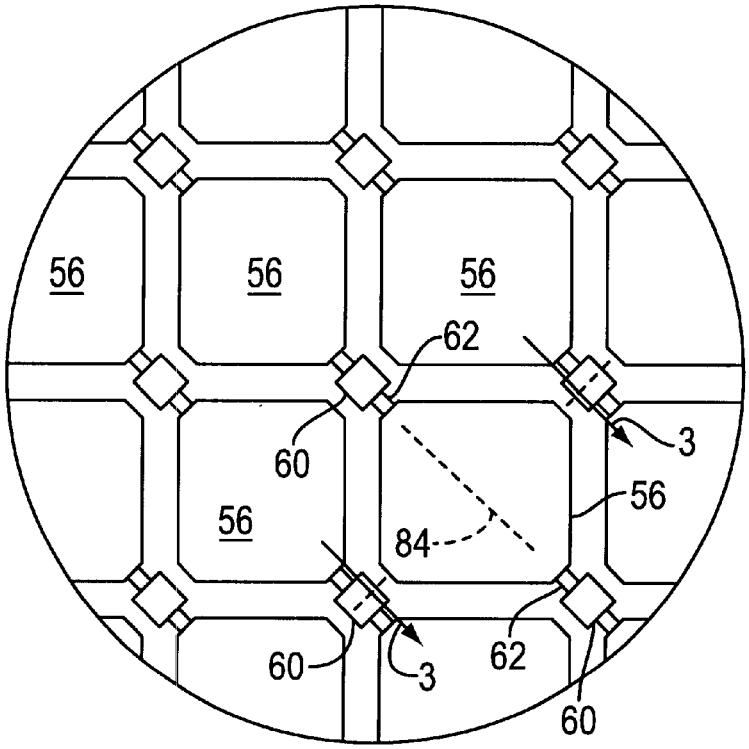
FIG. 2 is a top view of a detail 2 in FIG. 1, and shows micromirrors of a digital micromirror device that is employed as a spatial light modulator in the arrangement of FIG. 1.
Figure 3:
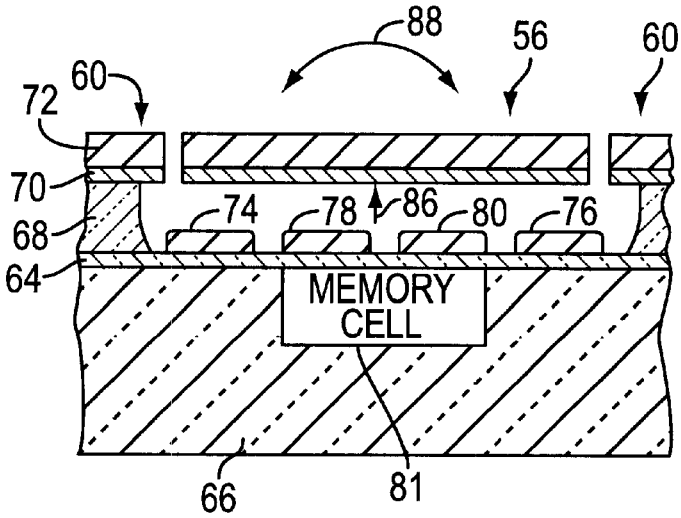
FIG. 3 is a sectional view of a single micromirror above a substrate.

With reference to FIGS. 2 and 3, each micromirror 56 is supported between a pair of posts 60 by torsion hinges 62. The posts 60 extend upward from a silicon dioxide layer 64 that has been deposited on a substrate 66. Each post 60 includes portions of an insulating spacer layer 68, a first metal layer 70, and a second metal layer 72. A micromirror 56 includes portions of both metal layers, while the torsion hinges 62 are fabricated from first metal layer 70 alone.

Landing electrodes 74 and 76 and actuation electrodes 78 and 80 are disposed below the micromirror 56. A negative bias voltage is selectively applied to the landing electrodes 74 and 76 and to the micromirrors 56.

The actuation electrodes 78 and 80 are connected to complementary outputs of a static memory cell 81. When a value is stored in memory cell 81, one of the actuation electrodes 78 and 80 is at ground potential and the other has a positive potential. This creates a torque urging the micromirror 56 to rotate clockwise or counter-clockwise about an axis 84. Axis 84 is perpendicular to the drawing in FIG. 3 at a position marked by an arrow 86, which can be viewed as a pivot point. However, the magnitude of the bias voltage applied to the micromirrors 56 and to the landing electrodes 74 and 76 is selected to that the micromirrors 56 are bi-stable in their operation. The bias voltage prevents the micromirrors 56 from moving in response to the torque exerted by the potentials on the actuation electrodes 78 and 80 until the bias voltage is relieved, whereupon the micromirrors 56 rotate to their new positions (if they are different from the old positions) or remain in their old positions (if they are the same as the new positions), and then the bias voltage is reapplied in order to electromechanically latch the micromirrors. This movement is indicated schematically in FIG. 3 by arrow 88. The micromirrors occasionally stick in one position or the other, possibly due to cold welding to one of the landing electrodes 74 or 76. Stuck micromirrors 56 can be dislodged by applying resonant reset pulses to the landing electrodes and micromirrors at a frequency corresponding to the resonance frequency of the micromirrors.

Further details of the fabrication and operation of DMD 46 can be obtained from U.S. Pat. Nos. 5,096,279, 5,280,277, and 5,452,024, and from an article by Jack M. Younse, entitled "Mirrors on a Chip," published at pages 27–32 of the November 1993 issue of *IEEE Spectrum*.

Returning now to FIG. 1, a lighting unit 90 exposes the micromirrors to red, green, and blue light having different intensity levels as the micromirrors are turned on and off to build up a frame image. A "frame image" is intended to refer to what is to be displayed by the pixels of all of the rows of micromirrors 56 that are to participate in forming an image during any one scanning cycle of array 58 (that is, a frame image consists of the pixels of all of the rows in array 58 if progressive scanning is used, and alternating rows if interlaced scanning is used). In what follows, it will be assumed that progressive scanning is employed, so that a frame image represents a complete snapshot of what is being displayed. The lighting unit 90 includes a monitor unit 92, an illumination unit 94, an intensity register 96, and a lamp driver unit 98.

The illumination unit 94 includes a color wheel 100, which is rotated by a motor 102 that is controlled by a motor control unit 104. A lamp unit 106 is disposed in a housing 108. The lamp unit 106 has a low-intensity lamp 110 and a high-intensity lamp 112. The intensity of lamp 112 is seven times greater than that of lamp 110. That is, if lamp 110 has an intensity of one in arbitrary units, lamp 112 has an intensity of seven, and both lamps together have an intensity of eight. An optical system 114, which is illustrated only schematically, collimates light from the lamp unit 106.

Figure 4:
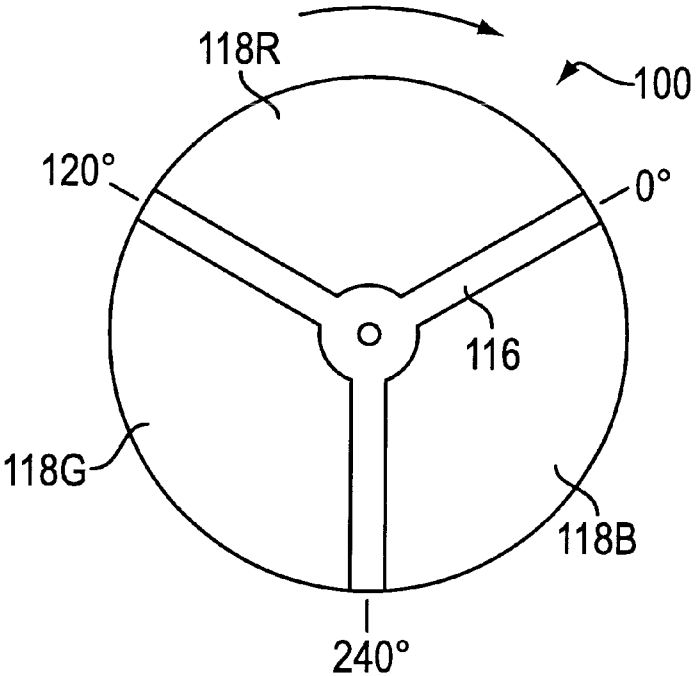
FIG. 4 illustrates a color wheel that is employed in the arrangement of FIG. 1.

Referring next to FIGS. 1 and 4 together, the color wheel 100 includes a frame 116 that supports a red filter 118R, a green filter 118G, and a blue filter 118B. The width of the arms of frame 116 will be generally ignored in what follows and, for convenience, it will be said that each of the colored filters provides a colored sector that extends (approximately) 120°. The red sector begins at 0°; the green sector begins at 120°; and the blue sector begins at 240° Motor control unit 104 generates angle information that is supplied to control unit 38 via a line 120. The angular information may be a train of pulses that are generated by a sensor (not illustrated) in the control unit 104, the sensor being linked to the motor's shaft. Once every revolution of color wheel 100, at the 0° mark, the motor control unit also generates a start-of-revolution signal (such as a long pulse) that is supplied to control unit 38 as part of the angular information. By counting pulses after the start-of-revolution signal, the control unit 38 is informed about which color sector is currently active, and how far that color sector has progressed.

The intensity register 96 in FIG. 1 receives a one-bit light intensity command signal from control unit 38 via a line 122, and the lamp driver unit 98 drives lamp unit 106 accordingly. The intensity command signal specifies either a low-light level (when the light-intensity command signal is 0), in which case only the low-intensity lamp 110 is driven, or a high-light level (when the light-intensity command signal is 1), in which case both the low-intensity lamp 110. and the high-intensity lamp 112 are driven to produce a total intensity of eight. The low-intensity lamp 110 is thus always on, while the high-intensity lamp 112 turns on and off.

The monitor unit 92 includes a light sensor 124 which senses the intensity of the light passing through color wheel 100, and generates a corresponding signal that is supplied to an amplifier 126 and thence to an analog-to-digital converter 128. The digital value of the sensed light intensity is then supplied to an integrator 130, which can be reset to zero by control unit 38 via a line 132. A light-level register 134 receives a multi-bit light-level integration value from control unit 38, and supplies it to a comparator 138, which sends a level-reached signal to control unit 38 via line 140 when the output of integrator 130 reaches the light-level integration value held in register 134. At this point, it is appropriate to note that the light intensity command that is received by register 96 is not the same as the light-level integration value that is received by register 134. The light intensity command indicates the instantaneous intensity that is desired—that is, whether only the low-intensity lamp 110 should be driven or whether the high-intensity lamp 112 should also be driven. The light-level integration value, in contrast, indicates the total amount or quantity of light that is desired, that is, the intensity times its duration.

Not yet mentioned in FIG. 1 is a bias and reset unit 142, which operates under the control of control unit 38 to supply the bias voltage and resonant reset pulses, as previously discussed. For purposes of the present invention, however, it is only necessary to consider the bias voltage, which is applied to array 58 to latch the micromirrors into their current positions as new data is being read into DMD 46, and is then temporarily relieved to permit the micromirrors to be moved into their new positions, whereupon the bias voltage is reapplied to latch the micromirrors at their new positions.

The operation of this embodiment will now be described with reference to FIG. 1 and the flowchart shown in FIGS. 5A and 5B. After one frame has been displayed, a new frame is stored in step 144 by transferring the red component of the new frame from memory 32 to memory 40, by transferring the green component of the new frame from memory 34 to memory 42, and by transferring the blue component of the new frame from memory 36 to memory 44. Memory 40, for example, stores video words corresponding in number and arrangement to the number and arrangement of micromirrors 56 in the DMD 46. In this example, each of the video words has seven bits. Memories 42 and 44 are similar, except that they store video words for the green and blue components of the image.

Memory 40 for the red component is selected in step 146. A bit-rank counter (not illustrated) in control unit 38 is set to zero, meaning the least significant bits of the red component, in step 148. The least significant bits for the video words of the red component are then read into DMD 46 during step 150.

In step 152, a check is made to determine whether the color wheel 100 is positioned at the beginning of its red sector (that is, 0°). When the color wheel reaches the beginning of the color sector, control unit 38 loads a light-level integration value for the bit rank designated by the bit rank counter into the light level register 134 (step 154). Since the bit rank counter was set at zero in step 148, the integration value loaded into register 134 during the first repetition designates the light level for exposing the pixels during display of the least significant bits. For convenience, this light level will be said to be "1" in arbitrary units. Then control unit 38 signals bias and reset unit 142 to latch the data read at step 150 into the DMD 46 (step 156). In the first repetition of the program's steps, the micromirrors 56 thus move to their positions for displaying the least significant bits of the red component of the image. Control unit 38 resets integrator 130 to zero in step 158. Consequently, the integrator 130 starts integrating the signal from light sensor 124. Control unit 38 increments the bit rank counter in step 160, and then reads the bit rank designated by the bit rank counter (LSB +1 during the first repetition) into the DMD 46 during step 162.

At the conclusion of step 162, new data has been read into the memory cells 81 of DMD 46, but the micromirrors 56 are still latched at their old positions, and integrator 130 is still integrating toward the light-level integration value for the previous bit rank. When this integration value is finally reached (step 164), a check is made to see whether the bit rank counter has been incremented to a value greater than 2 (step 166). If not, the program returns to step 154, and register 134 is loaded with the light-level integration value for the bit rank designated by the bit rank counter. The micromirrors are then latched at step 156 in accordance with the bit rank read into the bit rank counter in step 162, and steps 158–164 ensue.

Figure 6:
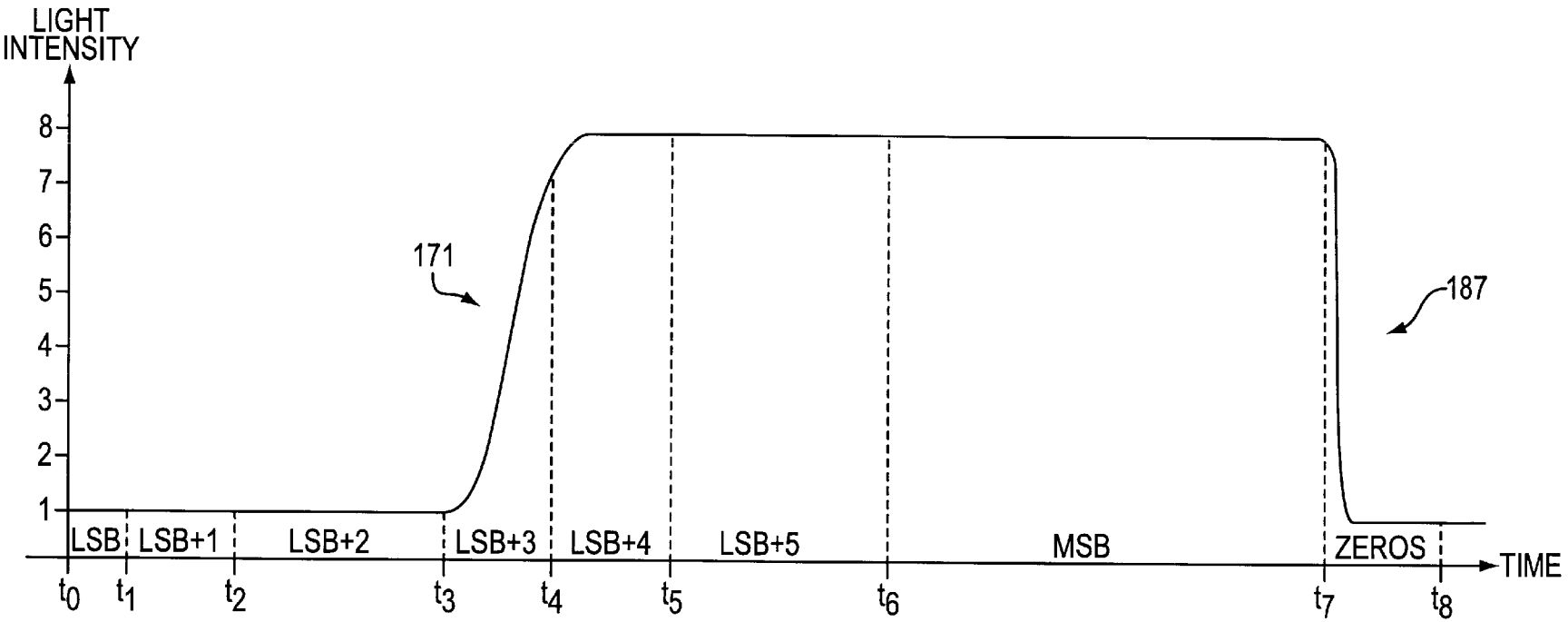
FIG. 6 is a graph showing an example of changing light intensities in the first embodiment.

In FIG. 6, the least significant bits of the video words of the red component are displayed during the period from $T_0$ to $T_1$. From the execution of step 156 until the return to step 156, the light intensity is 1 since low-intensity lamp 110 is always on. The next bits (LSB+1 ) are displayed during the period $T_1$ to $T_2$. They are displayed twice as long as the least significant bits because the light-level integration value for the second bits is twice as large as that for the least significant bits. The light-level integration value for the next bits, which are displayed from $T_2$ to $T_3$, is four times as large as that for the least significant bits, and therefore the pixels are exposed to light at intensity one during display of the third bits (LSB+2) for a period that is four times as long as the least significant bits.

Figure 5A:
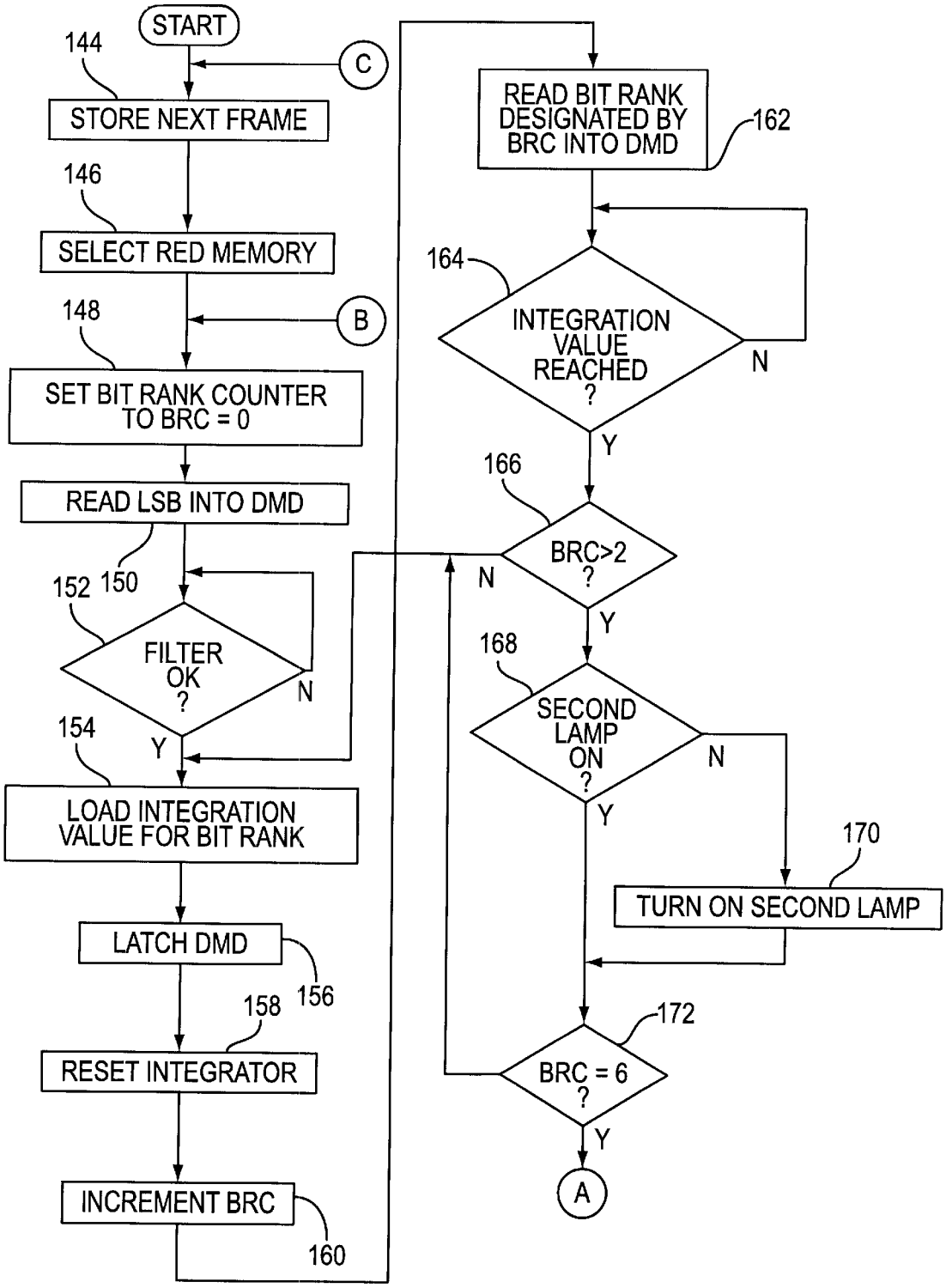
FIGS. 5A and 5B are a flow chart for operation of the arrangement shown in FIG. 1 in accordance with the first embodiment.
Figure 5B:
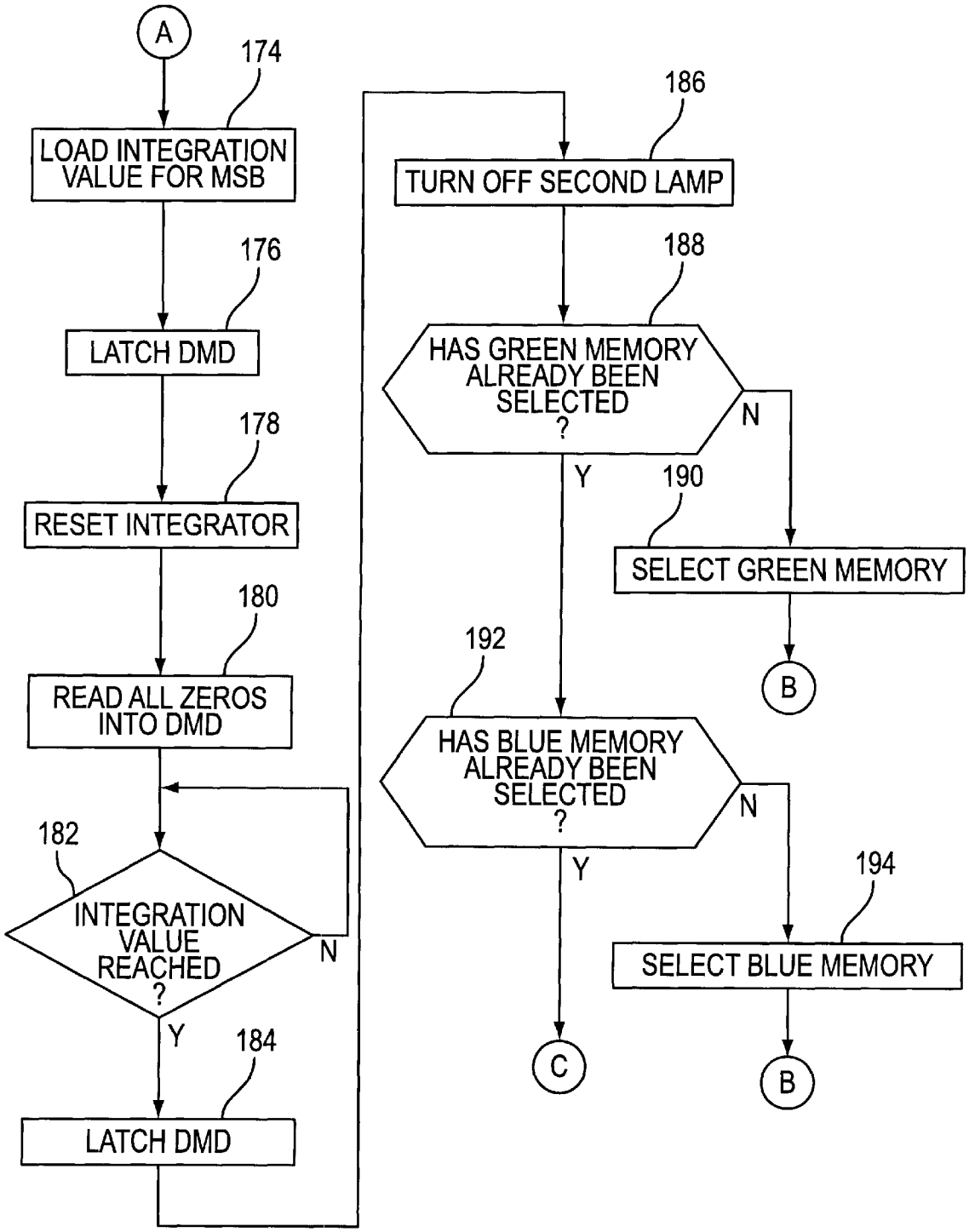

Returning now to step 166 in FIG. 5A, when the bit rank counter has been incremented to a value greater than two, a check is made at step 168 to determine whether the high-intensity lamp 112 has already been turned on. If not, it is turned on in step 170. FIG. 6 shows a transition region 171 when this occurs. The intention in FIG. 6 is not to show the actual turn-on behavior of lamp 112, which would depend upon the exact type of lamp and its age, and upon the particular nature of driver unit 98, but rather to indicate schematically a build-up period before lamp 112 reaches its full intensity. That is, the present invention does not demand a high-intensity lamp 112 that is capable of snapping full-on instantaneously. Rather, erratic or unruly behavior can be tolerated in transition region 171 (and, indeed, outside of the transition region) because the actual illumination is sensed and integrated.

A check is made at step 172 to determine whether the bit rank counter has been incremented to 6 (the most significant bit, since the video words have seven bits in this example). If not, the program returns to step 154, and LSB+3, LSB+4, and LSB+5 are displayed, as shown in FIG. 6. If the bit rank counter does indicate the most significant bit, however, the light-level integration value for the most significant bit is loaded into register 134 at step 174. The micromirrors 56 are then latched into their positions for displaying the most significant bits of the red component in step 176, and integrator 130 is reset to zero in step 178. While integrator 130 is integrating toward the light-level integration value for the most significant bits, zeros are read into the DMD 46 (step 180). A zero indicates the off position for a micromirror. When the integration value for the most significant bits is reached (step 182), the micromirrors are latched at their off positions (step 184). The high-intensity lamp 112 is then turned off in step 186, leaving only the low-intensity lamp 110 illuminated. FIG. 6 shows a transition region 187 back to a light-intensity level of one. The changing light intensity in transition region 187 does not matter, since zeros are displayed during the period from $T_7$ to $T_8$.

The period from $T_1$ to $T_8$ is very important since it acts as a sponge to absorb variations in the turn-on behavior of high-intensity lamp 112 (transition region 171) and variations in the level attained by lamp 112 when it is fully on. As lamp 112 ages, for example, its intensity might change from seven times that of the low-intensity lamp 110 to six times the intensity of lamp 110, and this would alter the locations of the times $T_4$–$T_7$ in FIG. 6. The time $T_8$ needs to be set far enough down the time axis that $T_7$ does not overtake $T_8$ while the lamps are operating in accordance with their design specifications. The time between $T_7$ and $T_8$ when DMD 46 displays all zeros and is effectively off can be termed a "buffer period" which, in conjunction with the sensing and integration of the light impinging on DMD 46, absorbs variations in the light produced by lamp unit 106 and thus tolerates less than perfect behavior by lamp unit 106.

The display of the red component of the image is complete when step 184 is executed. The angle signal emitted to control unit 38 by motor control unit 104 at this point is less than 120°. The color wheel 100 continues turning during the buffer period between $T_7$ and $T_8$. At step 188, a check is made to determine whether memory 42 for the green component of the image has already been selected. If not, it is selected at step 190, and the program returns to step 148 to display these seven bits of the video words for the green component of the image. In the first repetition of the program's steps during the green display, the filter is deemed to be OK (step 152) at the beginning of green sector 118G (that is, when the color wheel reaches 120°). After the green component of the image has been displayed, a check is made at step 192 to determine whether the memory 144 for the blue component has already been selected. If not, it is selected in step 94, and the blue component is subsequently displayed (steps 148–184). If the memory 44 has indeed already been selected, the program returns to step 144 to display the next frame.

Although color wheel 100 is used in FIG. 1 to color the light from lamp unit 106 before the light impinges on DMD 46, the color wheel 100 could be used instead to color the light after reflection by the micromirrors 56. The sensor 124, however, should measure the light before impingement on the DMD 46 since it would otherwise be necessary to correct the sensed amount of light in accordance with the on/off states of the micromirrors 56.

The Second Embodiment

The second embodiment is also based on the structure shown in FIG. 1. This structure is controlled in a different manner, however, to reduce the frequency at which the high-intensity lamp 112 is turned on and off.

Figure 7:
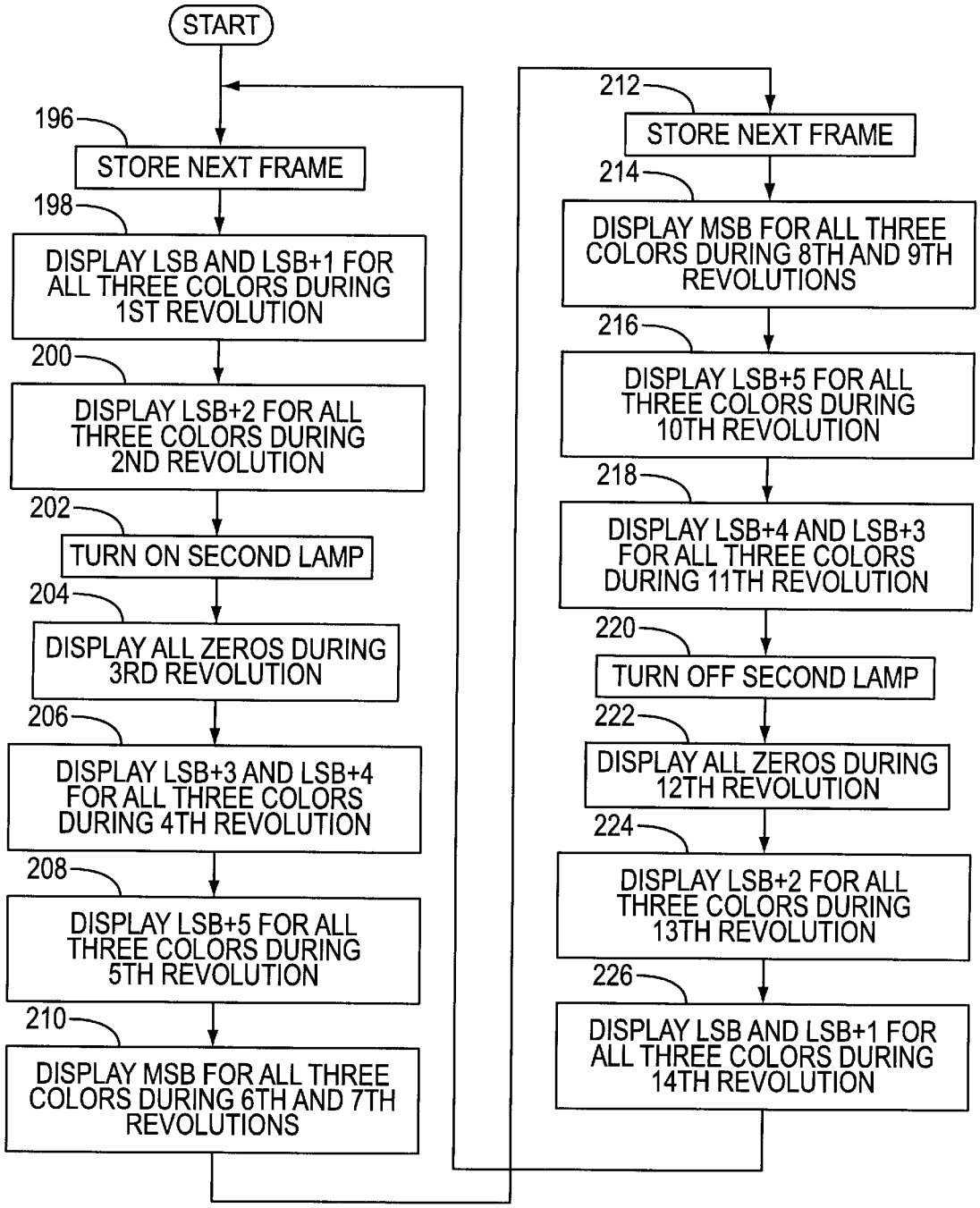
FIG. 7 illustrate a flow chart for operating the display apparatus shown in FIG. 1 in accordance with a second embodiment.

In FIG. 7, the red, green, and blue video words for the next frame are stored at step 196. Then, in step 198, the least significant bits and the next-to-least significant bits (LSB+1) are displayed for all three colors during a first revolution of the color wheel 100 (the details of step 198 will be described later with reference to FIG. 9A). This is shown schematically in FIG. 8A, which illustrates the three colored filters 118R, 118G, and 118B of the color wheel 100, and additionally indicates the angular segments through which the filters rotate during the display of the least significant bits and LSB+1. The cross-hatched regions in FIG. 8A indicate buffer periods during which the DMD 46 displays all zeros (that is, all of the micromirrors are in their off positions), and thus all of the pixels are dark. Only the low-intensity lamp 110 is on during the display of the LSB and LSB+1.

Figure 8A:
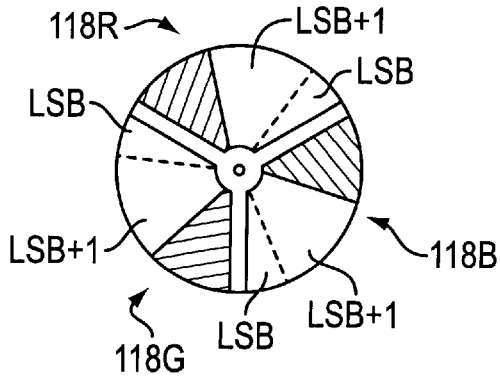
FIGS. 8A–8N schematically illustrate different bit ranks and buffer regions with respect to the color wheel while two fill frames are displayed in accordance with the second embodiment during fourteen revolutions of the color wheel.
Figure 8B:
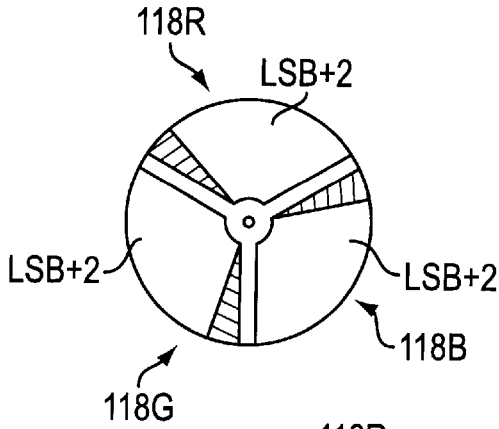

In step 200, the bits LSB+2 for all three colors are displayed during a second revolution of the color wheel 100, again with only the low-intensity lamp 110 being illuminated. This is shown in FIG. 8B. As before, the cross-hatched buffer periods in FIG. 8B indicate that the DMD 46 displays all zeros.

Figure 8C:
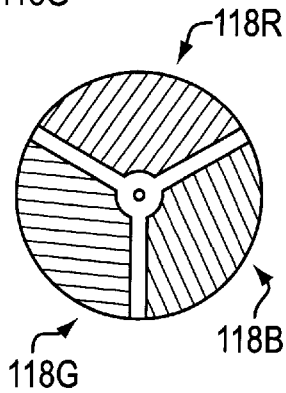
Figure 8D:
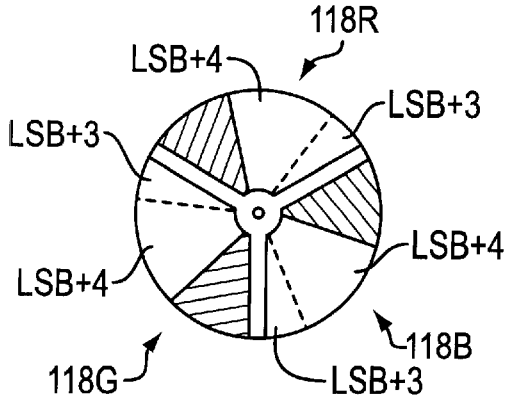

In step 202, the high-intensity lamp 112 is turned on, so that it shines along with the low-intensity lamp 110. As the intensity of lamp 112 rises, in the transition region 171 shown in FIG. 6, the DMD 46 displays all zeros (step 204) during a third revolution of color wheel 100. This is shown in FIG. 8C. Since the brightness of lamp 112 is selected to be seven times as great as that of lamp 110 when lamp 112 is fully on, the total intensity at the end of the third revolution is eight times as high as that during the first revolution (FIG. 8A). The display unit is now ready to display the LSB+3 and LSB+4 bits for all three colors during the fourth revolution (step 206). This is illustrated in FIG. 8D. The similarity between FIGS. 8D and 8A should be noted, with the difference being that the light is eight times as bright in FIG. 8D.

Figure 8E:
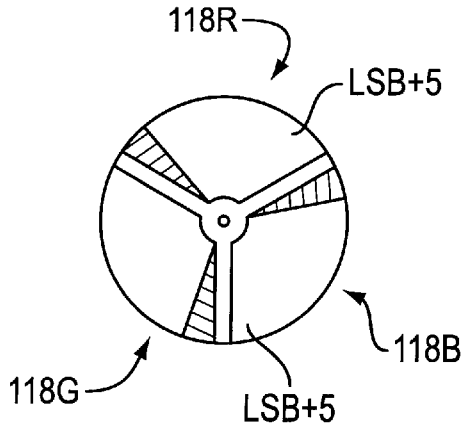

Next, in step 208, the bits LSB+5 are displayed for all three colors. This is shown in FIG. -8E, which corresponds to FIG. 8B except that the light intensity is eight times as high. It has previously been noted that the cross-hatched regions, when all of the micromirrors are in their off positions, .are provided so that variations in the light intensity can be absorbed. In FIG. 8E, the size of the angular segments for displaying the LSB+5 bits has been selected so that these bits can be fully displayed using (for example) four-fifths of each colored filter when each of the lamps 110 and 112 is shining at its design brightness. This leaves one-fifth of each colored filter (i.e., the cross-hatched buffer regions in FIG. 8E) to absorb variations if the intensity of either or both lamps falls to its lowest acceptable level as a result of aging, etc.

Figure 8F:
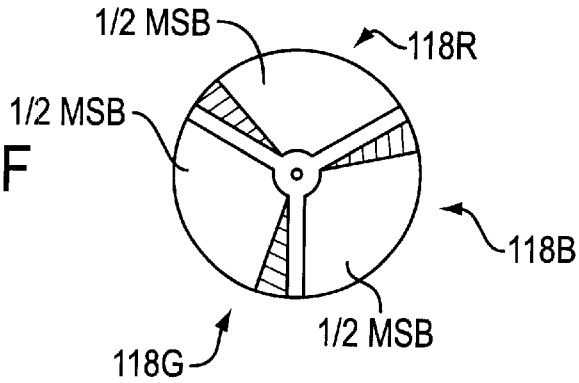
Figure 8G:
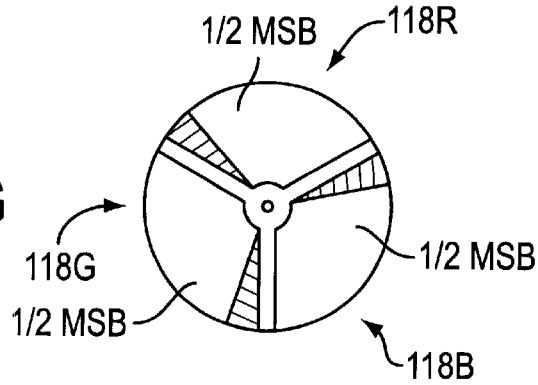
Figure 8H:
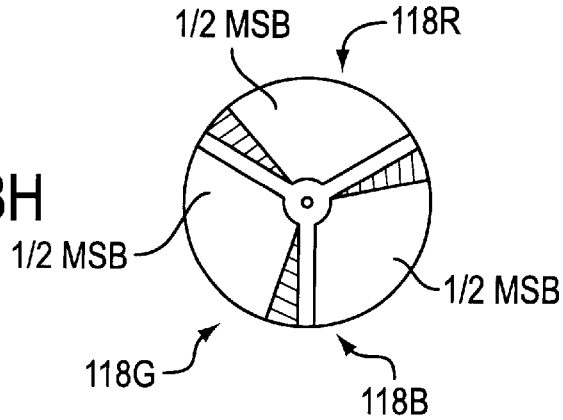
Figure 8I:
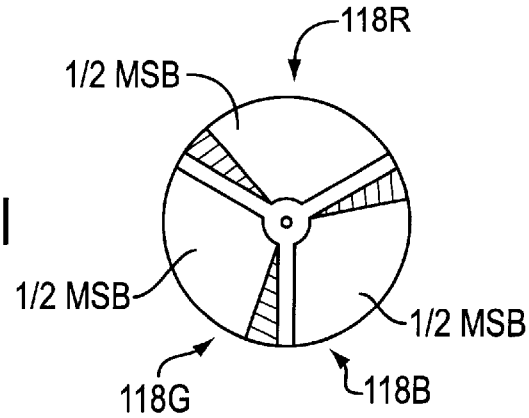
Figure 8J:
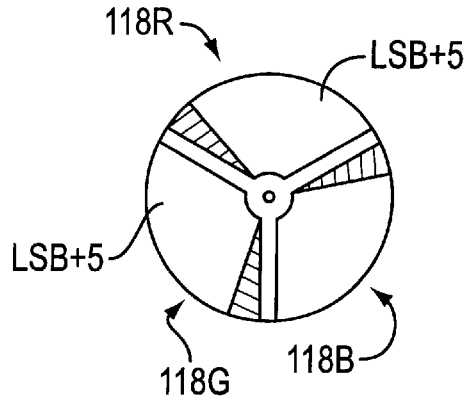
Figure 8K:
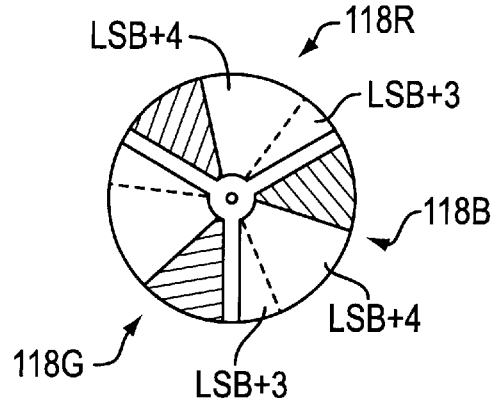

The most significant bits (LSB+6) for all three colors are displayed in the sixth and eighth revolutions (step 210), as shown in FIGS. 8F and 8G. The next frame is then stored (step 212), and the most significant bits for all three colors are displayed during the seventh and ninth revolutions of the color wheel 100 (step 214). This is shown in FIGS. 81 and 8J. The bits LSB+5 for all three colors are then displayed during the tenth revolution of the color wheel 100 (step 216), as shown in FIG. 8J. Thereafter, the bits LSB+4 and LSB+3 are displayed during the eleventh revolution (step 218), as shown in FIG. 8K.

The high-intensity lamp 112 is turned off in step 220, and the DMD 46 displays all zeros (step 222) during the twelfth revolution (FIG. 8L) as the light level falls to one-eighth of its previous value in the transition region 187 (FIG. 6). With only the low-intensity lamp 110 on, the bits LSB+2 for all three colors are displayed during the thirteenth revolution (FIG. 8M), and the bits for the LSB and LSB+1 for all three colors are displayed during the fourteenth revolution (step 226; FIG. 8N). At this point, the program returns to step 196 to store the next frame.

From the foregoing, it will be apparent that, in this embodiment, the video words for the red, green, and blue components for an image frame are not all displayed during a single revolution of the color wheel 100. Instead, the bits of the video words are displayed during a sequence of revolutions and, moreover, more than one revolution is devoted to displaying the most significant bits. The DMD 46 displays all zeros during a full revolution of the color wheel during the transition region 171 after the high-intensity lamp 112 has been turned on and during the transition region 187 after it has been turned off. A particular advantage of this embodiment is that the high-intensity lamp 112 only needs to be turned on and off once every two frames, or 30 times a second if the frame repetition rate is 60 frames per second.

Figure 8L:
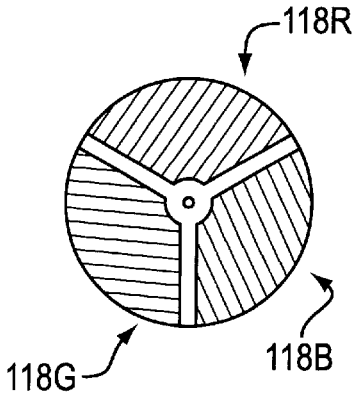
Figure 8M:
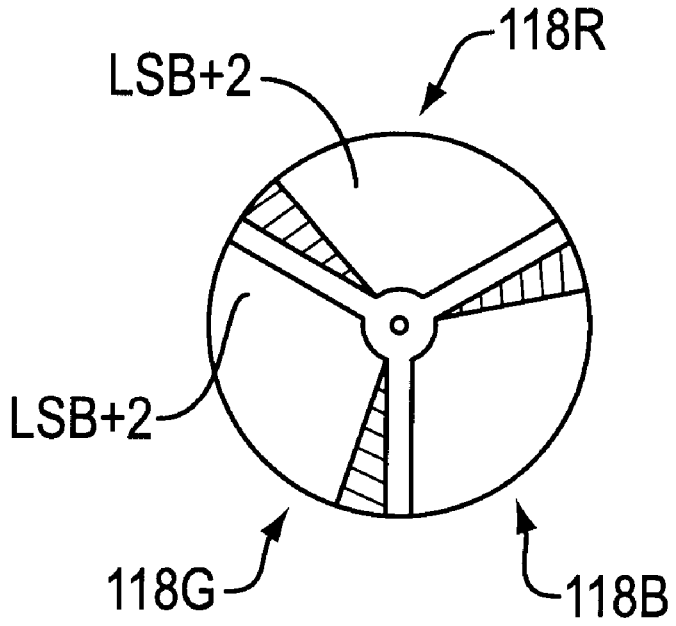
Figure 8N:
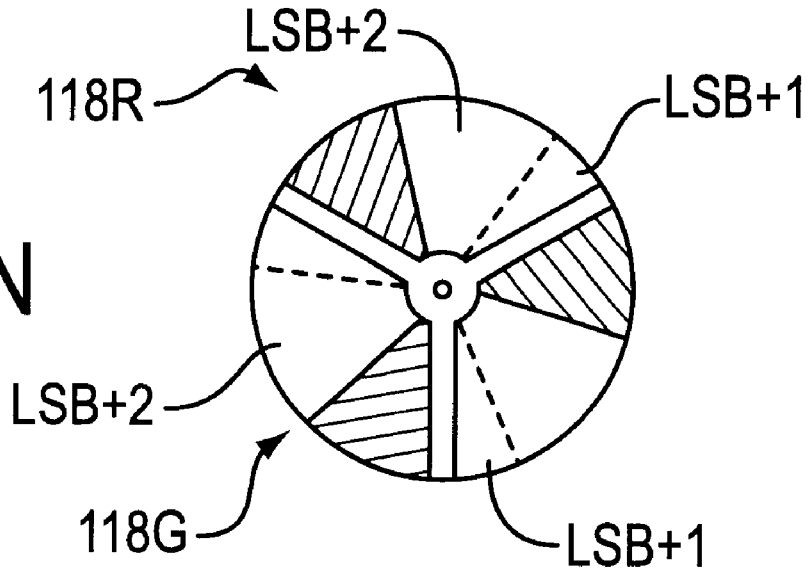

In the described embodiment, the DMD 46 displays all zeros for a full revolution of the color wheel during transition region 171, as shown in FIG. 8C, and for a full revolution during transition region 187, as shown in FIG. 8L. Depending upon the rise time and fall time of lamp 112, full revolutions may not be needed. For example, if the intensity of lamp 112 falls very rapidly, FIG. 8L could be omitted altogether. With a fairly rapid descent, it might be necessary to display all zeros only during the red filter, but it would then be necessary to complicate the program by starting up again after the all-zeros sector with the green filter for the LSB+2 bits, followed by the blue and red filters for the LSB+2 bits. Similar comments apply with respect to FIG. 8C and the transition region 171, with the added observation that it would be possible to display all zeros for more than one revolution if the rise time of the lamp 112 selected is sufficiently long or turbulent to warrant this.

Figure 9A:
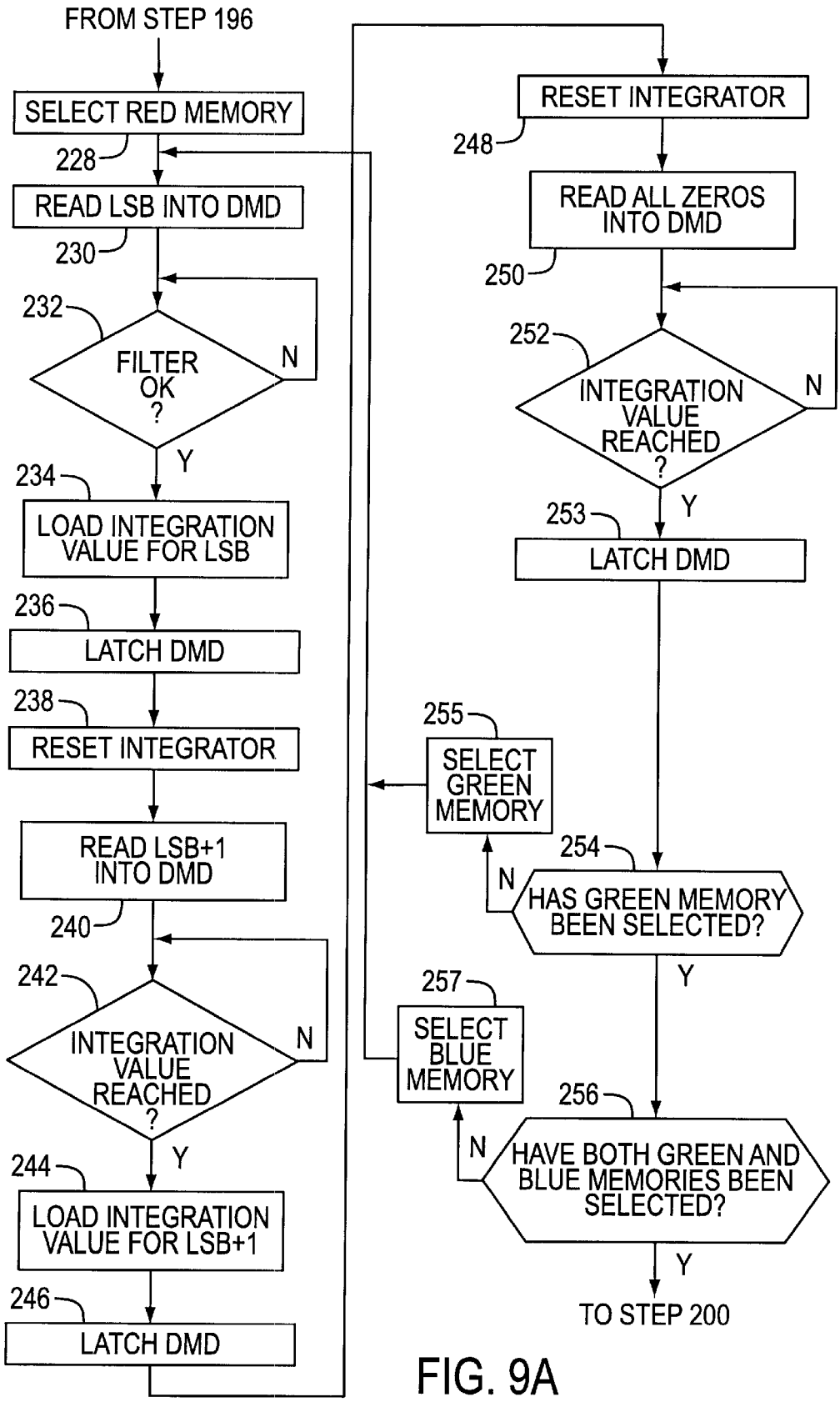
FIGS. 9A–9C are flow charts which illustrate three of the steps in FIG. 7 in more detail.

The details of step 198 are illustrated in FIG. 9A. The red memory 40 (FIG. 1) is selected in step 228, and the least significant bits of the red video words stored in memory 40 are read into DMD 46 in step 230. At step 232, a check of the angle information is made to determine whether the color wheel 100 is positioned at the beginning of the red filter 118R. If so, the light-level integration value for the least significant bit is loaded into the light-level register 134 during step 234, and the least significant bits that were read into the DMD 46 during step 230 are latched at step 236. Integrator 130 is reset to zero during step 238 and begins integrating toward the light-level integration value that was loaded in step 234. In step 240, the next-to-least significant bits (LSB+1) of the video words stored in the selected memory are read into DMD 46. When the integration value that was loaded in step 234 is reached (step 242), the light-level integration value for the LSB+1 bits is loaded into register 134 (step 244). The LSB+1 bits that were read into the DMD 46 at step 240 are then latched into the DMD during step 246, so that the DMD stops-displaying the LSB bits from the selected memory, and begins displaying the LSB+1 bits. Integrator 130 is reset during step 248, and begins integrating toward the integration value that was loaded into light-level register 134 during step 244. Then, during step 250, all zeros are read into DMD 46, while the LSB+1 bits remain latched into the DMD 46. When the integration value is reached, step 252, the zeros that were read into the DMD at step 250 are latched in step 253. The DMD thus starts displaying one of the hatched buffer regions in FIG. 8A.

A check is made at step 254 to determine whether the memory 42, which stores the video words for the green component of the image, has already been selected. If not, the green memory 42 is selected during step 255, and the process returns to step 230 to read the least significant bits of the green component into DMD 46. If the memory 42 has already been selected, a check is made at step 256 to determine whether the memory 44, which stores the video words for the blue component, has already been selected. If not, it is selected in step 257. If the blue memory has already been selected, the process continues to step 200 (FIG. 7) to display the LSB+2 bits of the three colors.

Figure 9B:
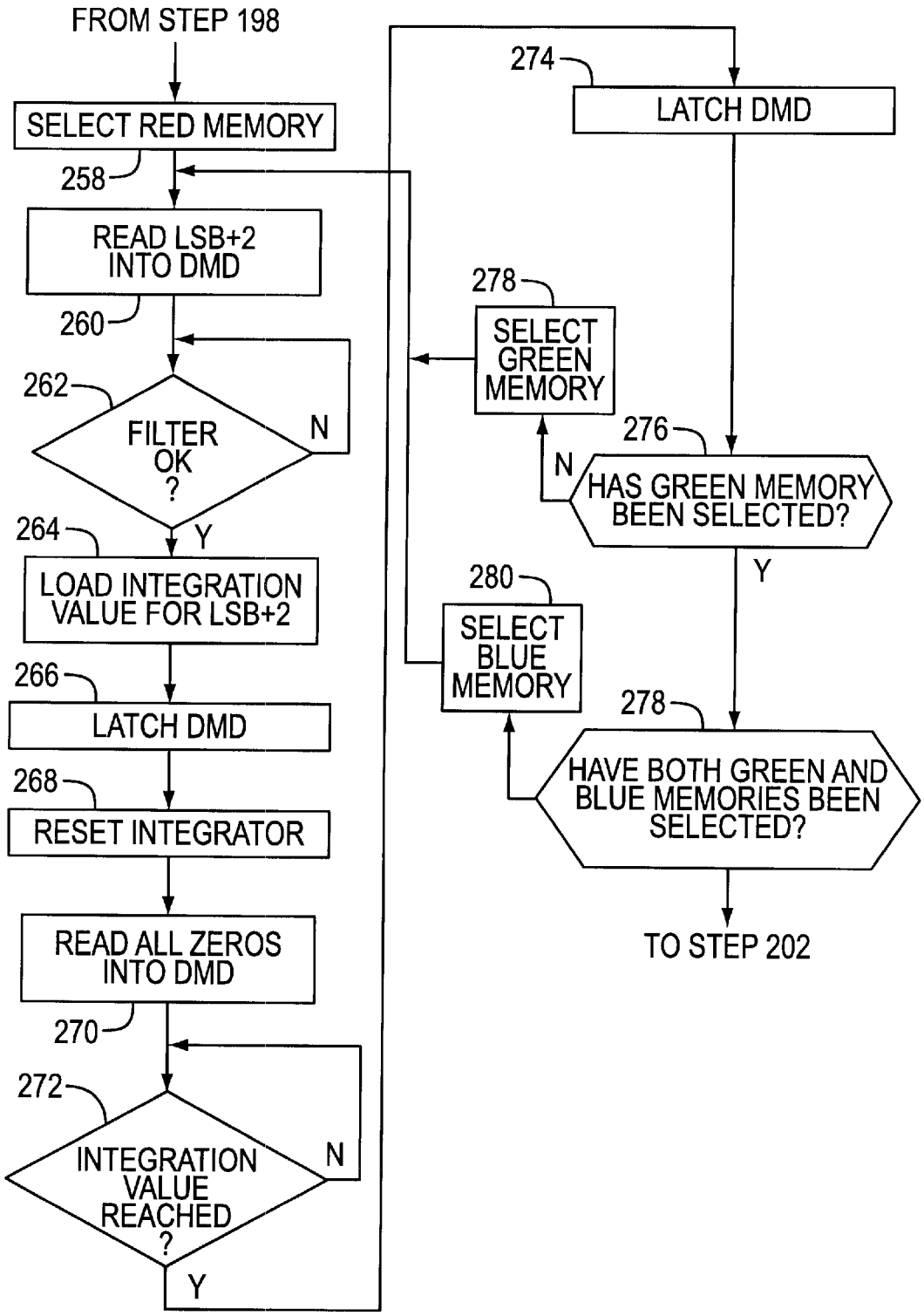

The details of step 200 are shown in FIG. 9B. At step 258, the memory 40, which stores the video words for the red component, is selected. The LSB+2 bits of the video words in the selected memory are read into DMD 46 during step 260, and a check is made a step 262 to determine whether the color wheel 100 is positioned at the start of the filter for the selected color. The control unit 38 loads the light-level integration value for the LSB+2 bits into light-level register 134 during step 264, and the LSB+2 bits are latched into DMD 46 during step 266. This begins the display of the LSB+2 bits of the selected color. The integrator 130 is immediately reset to zero during step 268, and begins integrating toward the light-level integration value that was loaded during step 264. All zeros are read into DMD 46 during step 270 while the DMD continues displaying the LSB+2 bits that were latched in step 266. After the integration value is reached during step 272, however, the zeros are latched into the DMD in step 274, resulting in one of the cross-hatched buffer regions shown in FIG. 8B. A check is made at step 276 to determine whether the memory 42, which stores the video words for the green component, has already been selected, and, if not, it is selected during step 278. With the DMD continuing to display all zeros, the LSB+2 bits for the green component are read into the DMD during step 260, the position of the color wheel 100 is checked during step 262 to determine whether the beginning of the green filter 118G has been reached, and, if so, the integration value for the LSB+2 bits is loaded in step 264. The LSB+2 bits are then latched into the DMD in step 266, whereupon the DMD stops displaying all zeros and begins displaying the LSB+2 bits of the green component.

If the memory 42 for the green component has already been selected when the check at step 276 is conducted, a further check is conducted at step 278 to determine whether the memory 44 for the blue component has also already been selected. If not, it is selected during step 280 and the process returns to step 260.

Figure 9C:
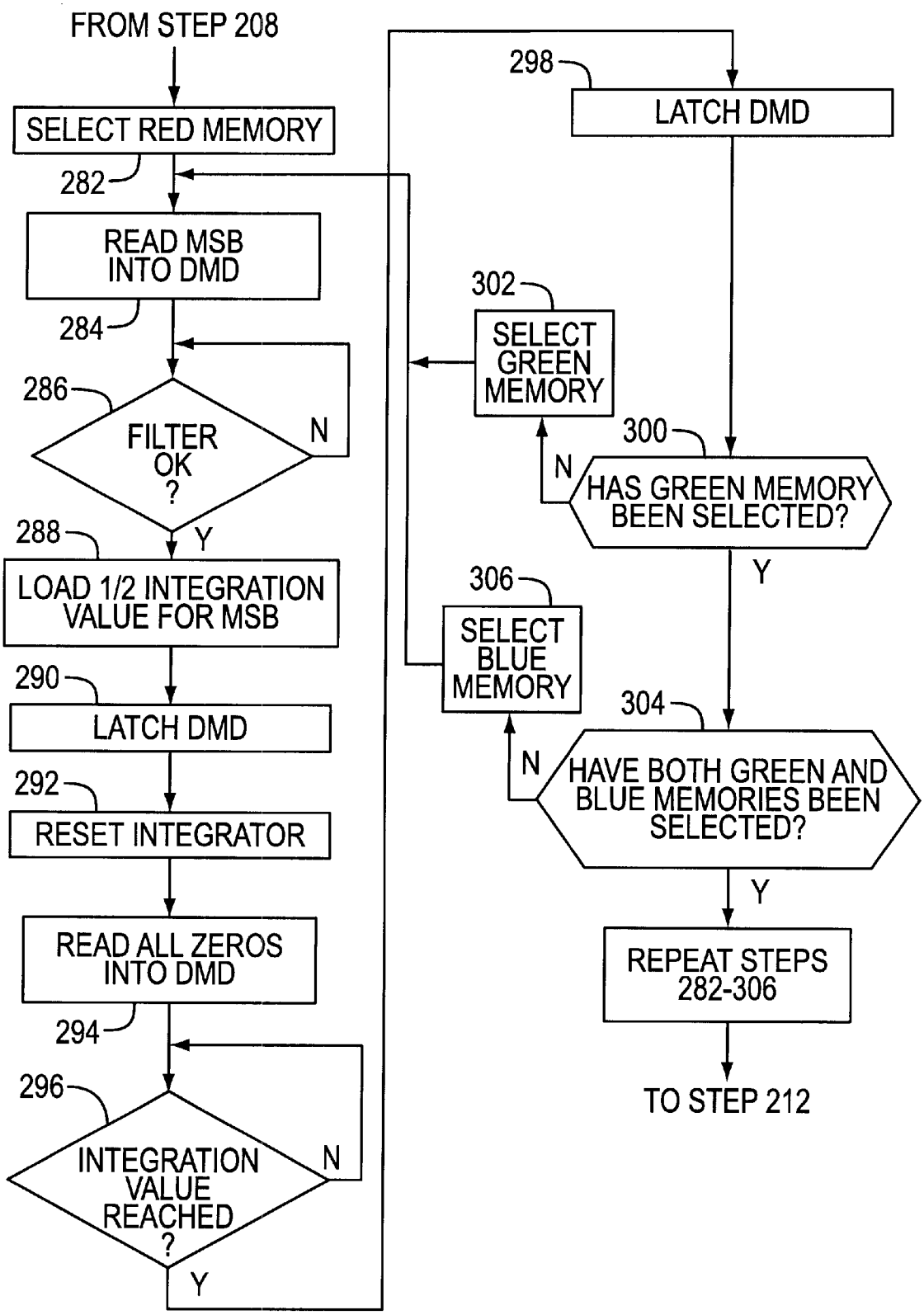

The details of step 210 (FIG. 7) will now be described with reference to FIG. 9C. The memory 40 which stores the video words for the red component is selected in step 282. The most significant bits of the video words in the selected memory are read into DMD 46 in step 284, and then a check is conducted at step 286 to see whether the color wheel 100 is positioned at the beginning of the filter 118 for the selected color. Since the light-level integration value for the MSB is too large to be reached during a 120° rotation of the color wheel 100, the control unit 38 loads half of the integration value into light-level register 134 during step 288. The most significant bits are then latched into DMD 46 during step 290, thus beginning their actual display. The integrator 130 is immediately reset to zero during step 292, and begins integrating toward the value loaded in step 288. Zeros are read into all locations of the DMD 46 during step 294 and, after the integration value loaded at step 288 (that is, one-half the light-level integration value for the MSB) has been reached, step 296, the zeros read in at step 294 are latched into the DMD at step 298, thereby turning all of the pixels off. This corresponds to one of the cross-hatched buffer regions in FIG. 8F. A check is made at step 300 to determine whether the memory 42 for the green component has been selected, and, if not, it is selected at step 302 and the process returns to step 284. If the green memory 42 has already been selected, however, a check is made at step 304 to determine whether the memory 44, which stores the video words for the blue component, has also already been selected. If not, it is selected at step 206, and the process returns to step 284. If the blue memory 44 has already been selected, steps 282–386 are repeated during the next revolution of the color wheel 100 in order to complete the display of the most significant bits of the red, green, and blue components.

The Third Embodiment

An advantage of the first and second embodiments is that the light level when the higherorder bits of the video words are displayed is relatively high, so that the higher-order bits can be displayed in a reasonably short period of time. When the lower-order bits are displayed, the light level is relatively low, so that these bits need not be displayed at a speed that unduly taxes the circuitry. Using a reduced light level when the lower-order bits are displayed means that more time is available for reading them into the DMD than would be the case if all of the bit ranks were displayed at the same light level. In the first and second embodiments, different light levels were attained by using a lamp unit 106 having a low-intensity lamp 110 that was permanently illuminated and a high-intensity lamp 112 that was turned on when the higher-order bits were displayed. Another way of achieving different light levels would be to use a single lamp, which is controlled so as to emit different light levels as needed. This possibility will be discussed in more detail later with reference to FIG. 14.

The third embodiment, however, achieves different light levels without multiple lamps and without a lamp that is driven at different emission levels. In the third embodiment, the lamp unit 106 in FIG. 1 is replaced by a single lamp (not illustrated) having a constant light output, and lamp-driver unit 98 and intensity register 96 are unnecessary.

Figure 10:
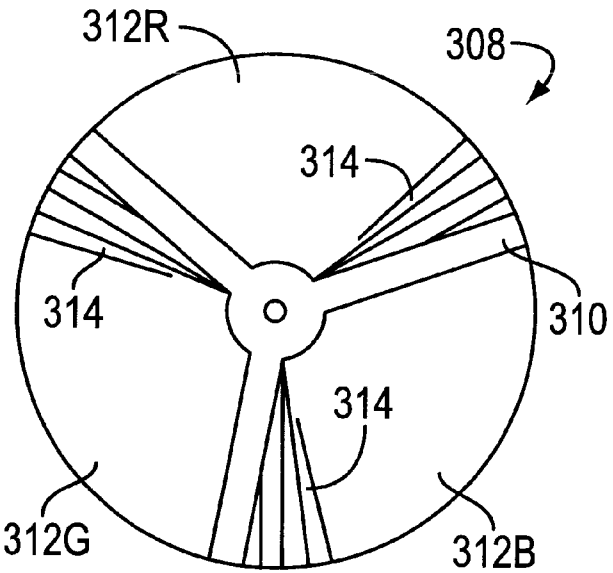
FIG. 10 illustrates a color wheel combined with attenuation regions to reduce the light intensity during display of the lower-order bits.

FIG. 10 illustrates a color wheel 308 having a frame 310 which mounts a red-color filter 312R, a green-color filter 312G, and a blue-color filter 312B. The initial portion of each of these filters has a light-attenuating region 314 which reduces the intensity of the light emitted by the lamp. As a result, when the color wheel 308 is positioned at the initial portion of any of the filters, the signal from sensor 124 in FIG. 1 is reduced and consequently it takes longer for integrator 130 to integrate to the light-level integration value stored in register 134. This lengthens the time available for displaying the lower-order bits, and thus also the time available for reading the lower-order bits into the DMD.

In FIG. 10, the attenuation regions 314 are integrated with the color filters in a single color wheel 308, but if desired, an attenuation filter wheel that is separate from the color wheel could be used.

Moreover, in lieu of attenuation regions either on the color wheel or a separate wheel, a ferroelectric LCD could be used to selectively control the level of light emitted by a single, constant-output lamp (or a plurality of lamps which together produce a constant output). One possibility would be to use an LCD having rows that are all on during display of the MSB, with half of the rows being on during display of the next-to-most significant bit, a fourth of the rows being on during display of the next bit, and so forth. Another possibility would be to use a single ferroelectric liquid crystal cell which is pulse-width modulated to provide binary attenuation levels.

The Fourth Embodiment

FIG. 14 illustrates a lighting unit 90' that is modified with respect to the lighting unit 90 in FIG. 1. Like lighting unit 90, lighting unit 90' includes a monitor unit 92. However, illumination unit 94', intensity register 96', and lamp driver unit 98' differ from the corresponding elements of lighting unit 90.

The illumination unit 94' is different in that its lamp unit 106' consists of a single lamp. It is driven at different binary levels by a lamp driver unit 98' in accordance with a multi-bit light-intensity command that is received by intensity register 96' via a bus 122'. The light-intensity command may designate two levels, a low level and a high level with eight times the intensity of the low level, as in the first embodiment. In such a situation, the light-intensity command for the low level would be 0001 and the light-intensity command for the high level would be 1000. Alternatively, the light-intensity command may designate a number of different binary light intensities. One possibility would be a straight progression (0 . . . 01, 0 . . . 10, 0 . . . 11, 1 . . . 11), in which case every bit rank of the video words would have its own intensity. Another possibility would be to use the same light intensity for pairs of bits in the video words. In accordance with this possibility, the light-intensity command would be 0 . . . 01 for both the least significant bit and LSB+1 of the video words, with the exposure being longer for LSB+1. For LSB+2 and LSB+3, the light-intensity command would be jumped to 0 . . . 10, with the exposure being longer for LSB+3 than for LSB+2. Thereafter, the light-intensity command would be jumped again, and so forth. It will be apparent that the same light-intensity command could also be used for triplets of bits in the video words, etcetera. Using the same light-intensity command for pairs, triplets, etc. of the video words may be desirable if the lamp that is used requires a relatively long period for stabilization when the light intensity is changed.

Instead of using a lamp unit 106 with a single lamp, the lamp unit could have two or more lamps that are driven in unison at energy levels that change during different time periods. One example would be a lamp unit with two lamps that are connected in parallel, in lieu of the single lamp shown in FIG. 14.

The Fifth Embodiment

The prior embodiments have been directed to arrangements in which all of the displayed pixels are updated simultaneously, by reading bit values into a DMD while the micromirrors are latched with a bias voltage and by then momentarily removing the bias voltage so that the micromirrors can respond to electrostatic forces corresponding the new bit values and move to their new positions. The present invention, however, is not limited to displays which can be updated simultaneously; instead, in the present embodiment, the bits that are to be displayed are updated row-by-row. Although the techniques employed in this embodiment are applicable to DMDs, they will be explained using an example in which the addressable spatial light modulator is a ferroelectric liquid crystal display panel. Such a panel is comprised of bi-stable pixels or cells, meaning that they are either on or off without intermediate gray levels, and the cells respond very quickly to applied signals.

Figure 11:
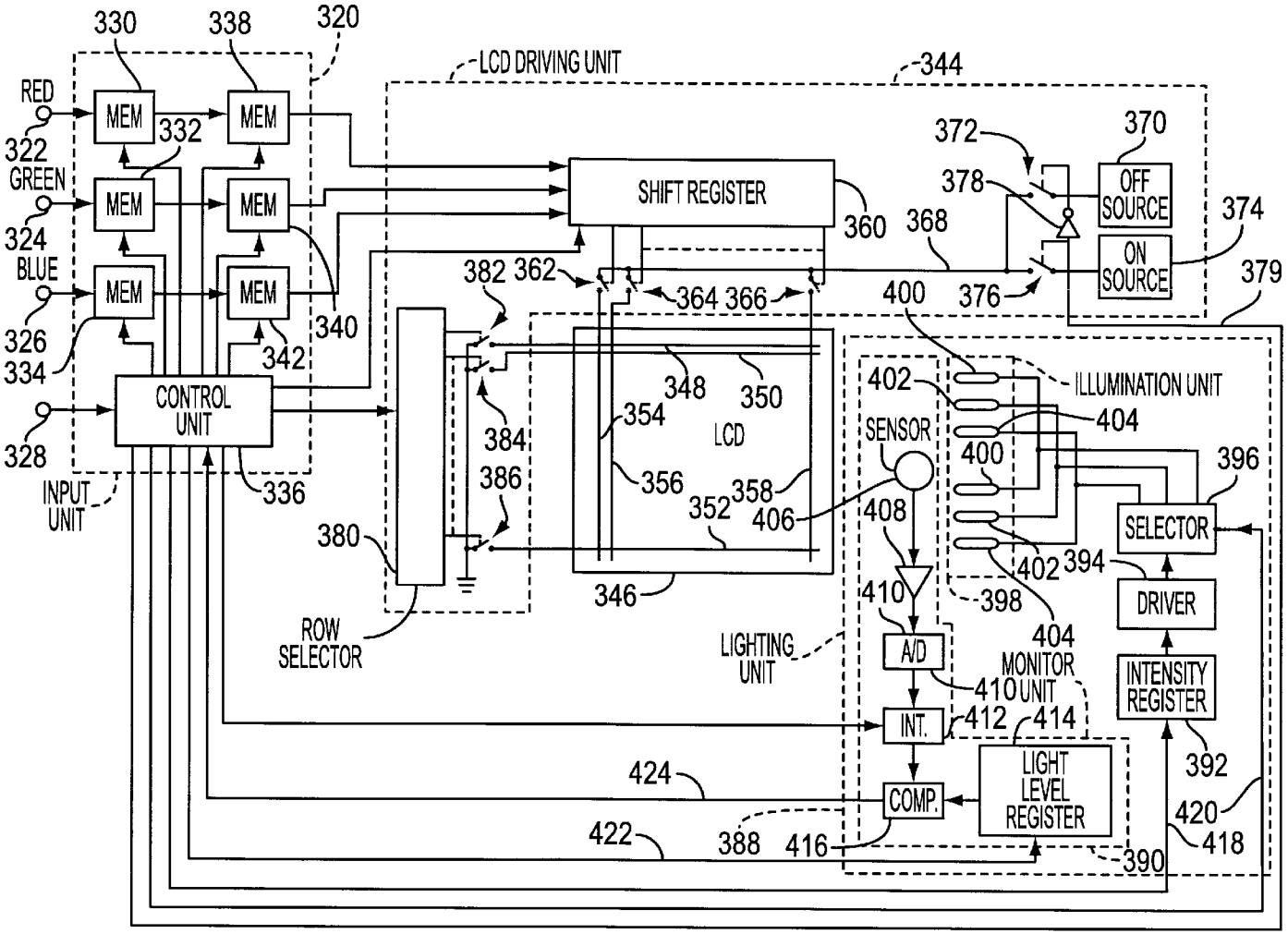
FIG. 11 is a block diagram of a display apparatus in which the spatial light modulator is a ferroelectric LCD which is addressed with video information on a row-by-row basis.

In FIG. 11, an input unit 320 has an input terminal 322 for receiving a digitized signal for the red component of an image, an input terminal 324 for receiving a digitized signal for the green component, an input terminal 326 for receiving a digitized signal for the blue component, and an input terminal 328 for receiving a synchronization signal. The digitized signals for the red, green, and blue components consist of seven-bit video data words, so that each video word specifies one of 128 levels of red, green, or blue intensity for a point that is to be displayed. The video words for the red, green, and blue components are stored in respective frame memories 330, 332, and 334 under the control of a control unit 336. When a full frame is stored, control unit 336 transfers the contents of memories 330–334 to further frame memories 338, 340, and 342, and then begins storing the next frame in memories 330–334. Control unit 336 also reads out the contents of memories 338–342 to an LCD driver unit 344, which addresses a ferroelectric LCD panel 346 with data from memories 338–342.

The ferroelectric LCD panel 346 has row electrodes and column electrodes which cross, with liquid crystal material between them, to provide a matrix of pixels having rows and columns. The row electrodes include a first row electrode 348, a second row electrode 350, and so on, to a last row electrode 352. The column electrodes include a first column electrode 354, a second column electrode 356, and so on, until the last column electrode 358.

LCD driving unit 344 includes a shift register 360 having the same number of stages as there are column electrodes in LCD 346. The first stage is connected to an electrically controlled switch 362, the second stage is connected to an electrically controlled switch 364, and so on until the last stage, which is connected to an electrically controlled switch 366. A switch is closed if its corresponding shift register stage contains a one, and it is open if the corresponding stage contains a zero. All of the switches are connected to a line 368. Driving unit 334 also includes an OFF voltage source 370 which can be connected by an electrically controlled switch 372 to the line 368, and an ON voltage source which can be connected by an electrically controlled switch 376 to the line 368. An inverter 378 is connected to a line 379 from the control unit 336. When line 379 carries a zero, switch 376 is open and switch 372 is closed. On the other hand, when line 379 carries a one, switch 376 is closed and switch 372 is open. Thus, the signal on line 379 controls whether OFF source 370 or ON source 374 is connected to line 368.

The LCD driving unit 334 also includes a row selector 380. It has stages which can be strobed to sequentially close an electrically controlled switch 382 that is connected to first row electrode 348, an electrically controlled switch 384 that is connected to the second row electrode 350, and so on to a switch 386 that is connected to the last row electrode 352. Each of the switches, when closed, connects the corresponding row electrode to ground. When the switches are open, the row electrodes are left electrically floating.

FIG. 11 also illustrates a lighting unit 388 which includes a monitor unit 390, an intensity register 392, a lamp driver unit 394, a color selector 396, and an illumination unit 398. Physically, the illumination unit 398 is disposed behind LCD panel 346, with a light diffusion plate (not illustrated) being inserted between the illumination unit 398 and the LCD panel 346 in order to spread light emitted by the illumination unit 398 evenly on the back of LCD 346. The illumination unit includes red fluorescent lamps 400, green fluorescent lamps 402,. and blue fluorescent lamps 404. Although only two lamps for each color are illustrated, more may be included if this is desirable to provide even illumination of the back of LCD 346 for each color.

The monitor unit 390 includes a sensor 406 which is positioned to sense the light emitted by illumination unit 398, an amplifier 408 which amplifies the signal generated by sensor 406, an analog-to-digital converter 410 which converts the amplified sensor signal to a digital value, an integrator 412 which repeatedly adds the digital signal in order to integrate it, a light-level register 414, and a comparator 416 which compares the output of register 414 with the output of integrator 412.

The control unit 336 emits a one-bit light-intensity command on line 418 to the light intensity register 392. When the light-intensity bit is zero, this indicates that driver 394 is to drive illumination unit 398 so that it emits a low-light level. When the light intensity bit is high, illumination unit 398 is driven to emit a high-intensity level having a magnitude that is eight times the low-intensity level. A two-bit color selection signal emitted by control unit 336 on bus 420 indicates which color light should be selected by selector 396. When the color selection signal is 00, selector 396 connects driver 394 to the red lamps 400. When the color selection signal is 01, selector 396 connects driver 394 to the green lamps 402. When the color selection signal is 10, the blue lamps 404 are selected.

Control unit 336 emits a multi-bit light-level integration signal to light-level. register 414 via a bus 422. Register 414 supplies the light-level integration signal to the comparator 416, whose output to control unit 336 on line 424 is zero as long as the integrated value from integrator 412 is smaller than the light-level integration signal. When the integrated value reaches the value of the light-level integration signal, comparator 412 supplies a one on line 424 to signal control unit 336.

Before describing the operation of the arrangement shown in FIG. 11, it would be useful to explain how ferroelectric LCD 346, with its bi-stable (on or off) liquid crystal cells, can be used to achieve a gray scale. The explanation will be provided by way of analogy to a room having a window with Venetian blinds, the blinds having 60 slats that can be opened or closed. Typically, the slats of Venetian blinds are linked so that they are all opened or closed together, but in the following discussion, it will be assumed that the slats can be opened or closed individually.

Suppose that it is noon on a cloudless day, so that the illumination outside the room is constant and does not fluctuate, and that all 60 of the slats are initially closed so that no light enters through the window. If we open the top slat (slat number 0), light begins streaming through. After a predetermined time delay period, we open the next slat (slat number 1) and light begins streaming through it, too. After two times the predetermined delay period, we open the next slat (number 2), and so on, until the bottom slat (number 59) is opened. By the time the bottom slat has been opened, light has been streaming through the top slat for a period of time that is equal to the predetermined delay period times 59. Light has been streaming through the next-to-top slat (slat number 1) for a period of time equal to the predetermined delay times 58, and so forth. One delay period after the bottom slat has been opened, we close the top slat; the total amount of light passing through the top slat while it was opened is thus proportional to 60 slats times the delay period. After another delay period, we close the next-to-top slat; the total amount of light passing through it while it was open is also proportional to 60 times the delay period. The slats are thus closed in sequence in this way, and by the time the bottom slat is closed, the total amount of light that passed through it will again be proportional to 60 times the delay period.

It should be noted that it is not necessary to start the slat-closing sequence immediately after the slat-opening sequence has been completed. When all the slats are opened, the light through each of them is the same. All that is necessary for a constant amount of light through each of the slats when the outside illumination does not fluctuate is that they are opened in sequence at some particular speed and later closed in sequence at the same speed.

Now, consider the case in which the outside illumination level is not constant, but fluctuates instead. Suppose we are back in our room with the Venetian blinds at dawn, as the sun is rising and the external light level is thus increasing. If we were to open the slats from top to bottom and then close them from top to bottom at the same speed, the result would be more light through-the bottom slat than the top slat. The reason is that it would grow brighter outside during the time between the top slat being opened and the bottom slat was opened, and it would also grow brighter outside during the time between the top slat being closed and the bottom slat being closed. But suppose that, when the top slat is opened, we begin integrating the light that passes through it. When the integrated light reaches a predetermined value, which will be called an "integration increment Δ," we open the second slat. Light is now streaming through both the first slat and the second slat at the same rate. By the time the integrated amount of light through the first slat has reached two times the predetermined integration increment Δ, the integrated amount of light through the second slat will reach one times Δ, and we open the third slat. This opening process continues to the bottom slat, with the time delay between one slat and the next growing shorter because the light intensity outside is increasing. By the time the bottom slat (number 60) is opened, however, the total amount of light that has entered the room via the top slat is proportional to 59 times the integration increment Δ. If we now begin closing the slats in sequence from the top to the bottom, in accordance with the integrated amount of light, the amount of light that entered through each slat will be the same as the amount that entered through every other slat. Furthermore, instead of starting the closing sequence immediately after the opening sequence has been completed, we can allow light to enter through all of the slats for any amount of time that is needed, and then sequentially close them in accordance with the integrated light value and still wind up with a constant amount of light through each of the slats while they were open.

Enough of Venetian blinds. It is time to return to the arrangement shown in FIG. 11. An overview of the operation of this arrangement will now be presented, followed by a more detailed discussion.

Assume that an old frame has just been displayed and all of the cells or pixels of LCD 346 are off. Also assume that the red lamps 400 have been selected and are being driven at the low level. Control unit 336 emits a one on line 379, thus closing switch 376 and connecting ON source 374 to line 368. Control unit 336 also reads out a row's worth of the least significant bits (LSB) of the red component of the new frame from memory 338 to shift register 360. Depending on the contents of the row, switches 362–366 may open and close as the row is being shifted into register 360, but this has no influence since all of the row electrodes 382–386 are floating. After the row has been completely shifted in, the switches 362–366 have states corresponding to the values of the least significant bits of the first row of the red component. Control unit 336 then causes row selector 380 to strobe the first row switch 382, thereby connecting the first row electrode 348 to ground. At this point, cells in the top row of LCD 346 will be turned on by ON source 374 if the corresponding column switches 362–366 are closed. Row electrodes whose column switches are open are not connected to ON source 374, and thus the corresponding cells of the top row of LCD 346 remain off.

When control unit 336 causes row selector 380 to strobe the first row switch 382, thereby causing the least significant bits of the red component for the top row to be displayed on LCD 346, it also clears integrator 412 to zero and emits a light-level integration value to register 414. The light-level integration value that is loaded into register 414 when the first row switch 382 is strobed (which can be called "row switch number zero," corresponding to row number zero of LCD 346) is one times a predetermined integration increment Δ. Integrator 412 then begins integrating toward the light-level integration value (1×Δ) stored in register 414. The second row of least significant bits for the red component is then shifted into register 360, and when the integrated value from integrator 412 reaches the light-level integration value, comparator 416 emits a signal on line 424 to the control unit 336, which thereupon causes row selector 380 to strobe the second row switch 384 (row switch number one). Cells in the second row of LCD 346 are thus turned on in accordance with the least significant bit of the red component. Control unit 336 then updates the light-level integration value in register 414 to two times Δ, shifts the next row of least significant bits of the red component into shift register 360, and so forth. Row-by-row, the cells of LCD 346 are thus turned on in accordance with the LSB bits of the red component, with the light-level integration value that is loaded into register 414 being increased in increments of Δ.

After the last row electrode 352 has been strobed, control unit 336 opens switch 376 and closes switch 372, thus connecting OFF source 370 to line 368. Control unit 336 also clears integrator 412 and again loads one times the integration increment Δ into register 414 as the light-level integration value. The first row of least significant bits of the red component is again shifted into shift register 360, and row selector 380 strobes the first row switch 382. This turns off the cells in the top row of LCD 346 that were previously turned on. The cells in the top row that were not turned on are left as they were, that is, off. The least significant bits of the red component for the second row are then shifted into register 360, and the second row switch 384 is strobed when the value in integrator 412 reaches one times Δ. This procedure continues until all of the cells in LCD 346 that were turned on in accordance with the least significant bits of the red component are turned off in accordance with the least significant bits of the red component. After they have all been turned off, the same amount of light has gone through each of the cells that were turned on and subsequently turned off.

After the LSB bits of the red component have been displayed in this way, the next-toleast significant bits (LSB+1) of the red component is also displayed in the same manner. The illumination unit 398 is still driven at the low level. The difference with respect to the least significant bits is that, after the liquid crystal cells have been turned on in accordance with the LSB+1 bits, they remain on for a "dwell period" that is determined by a light-level integration value that is loaded into register 414 after the last row has been strobed, and then they are turned off in sequence. For LSB+1, the dwell period is set so that the same amount of light passes through the turned-on cells as passes through during the turn-on and turn-off sequences.

The next-least-significant bits of the red component, LSB+2, are displayed in the same manner, with the illumination unit 398 still being driven at the low level. The dwell period is three times larger than the dwell period for LSB+1.

Figure 12:
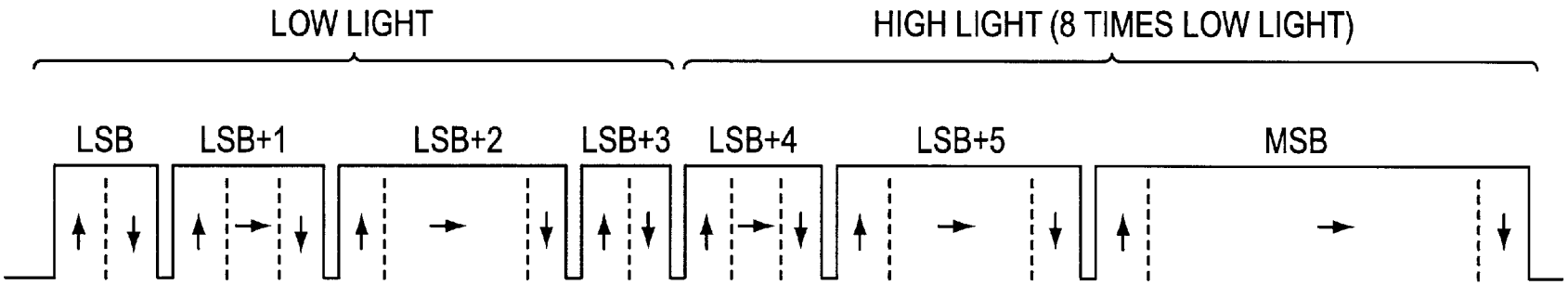
FIG. 12 illustrates turn-on periods, turn-off periods, and dwell periods for different bit ranks and light intensity levels.

After LSB+2 of the red component has been displayed by turning the cells of LCD 346 on row-by-row in accordance with LSB+2 and then turning them off row-by-row, control unit 336 emits a one over line 418 to intensity register 392. Driver 394 thereupon begins driving illumination unit 398 at the high level, which is eight times the low level in this example. The cells of LCD 346 are then turned on and off in accordance with LSB+3 of the red component. Since the light intensity is now eight times that when the least significant bits were displayed, the dwell period disappears. This is shown in FIG. 12, where upward arrows indicate turn-on periods, downward: arrows indicate turn-off periods, and horizontal arrows indicate dwell periods. After LSB+3 has been displayed, LSB+4, LSB+5, and the most significant bit, MSB, are displayed by turning the cells on in accordance with the respective bit rank and then turning them off after appropriate dwell periods.

After all of the bits of the red component have been displayed, the green and blue components are then displayed in the same way. The apparatus is then ready to display the next frame.

Figure 13A:
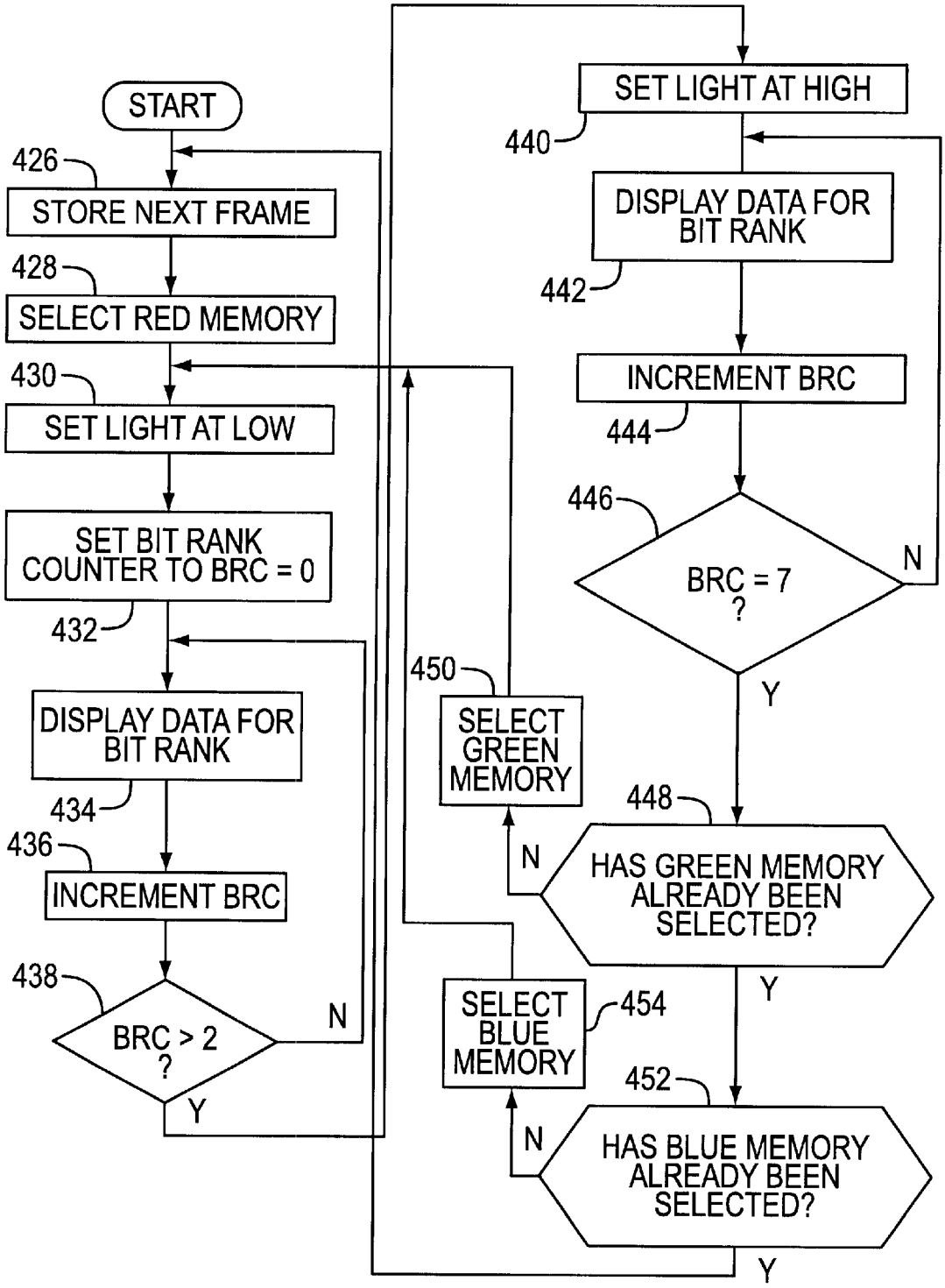
FIG. 13A illustrates a flow chart for operation of the arrangement shown in FIG. 11.

FIG. 13A illustrates the display process described above. In step 426, control unit 336 stores the red, green, and blue components for the next frame in memories 338–342. It then selects red memory 338 in step 428 to supply video data to shift register 360.

In step 430, control unit 336 emits a zero on line 418 to intensity register 386, indicating that driver 394 is to drive illumination unit 398 at the low level. A bit rank counter (not shown) within control unit 336 is then set to zero, indicating the least significant bit, in step 432. The least significant bits of the red component are then displayed on LCD 346 in step 434. This will be described in more detail later.

The bit rank counter in control unit 336 is then incremented in step 436. The content of the bit rank counter is then checked, in step 438, to see whether it is greater than two. If not, the process returns to step 434, and the new bit rank of the red component is displayed. If it is determined at step 438 that the content of the bit rank counter is indeed greater than two, control unit 336 emits a one to intensity register 392. In response, driver 394 drives illumination unit 398 at the high level, eight times greater than the low level (step 440). The data for the bit rank is then displayed in step 442, and the bit rank counter is incremented in step 444. Since the most significant bit in this example is equivalent to LSB+6, in step 446 a check is made to determine whether the content of the bit rank counter is now seven. If not, the process returns to step 442 for display of the new bit rank.

When the content of the bit rank counter reaches seven (Y at step 446), a check is made at step 448 to determine whether green memory 340 has already been selected. If not, it is selected in step 450 in lieu of the red memory 338, and the process returns to step 430. If the green memory has already been selected (Y at step 448), a check is made at step 452 to determine whether the blue memory 342 has also been selected. If not, it is selected in step 454, and the process returns to step 430. If the blue memory has indeed already been selected (Y at step 452), the process returns to step 426 for storage of the next frame.

Figure 13B:
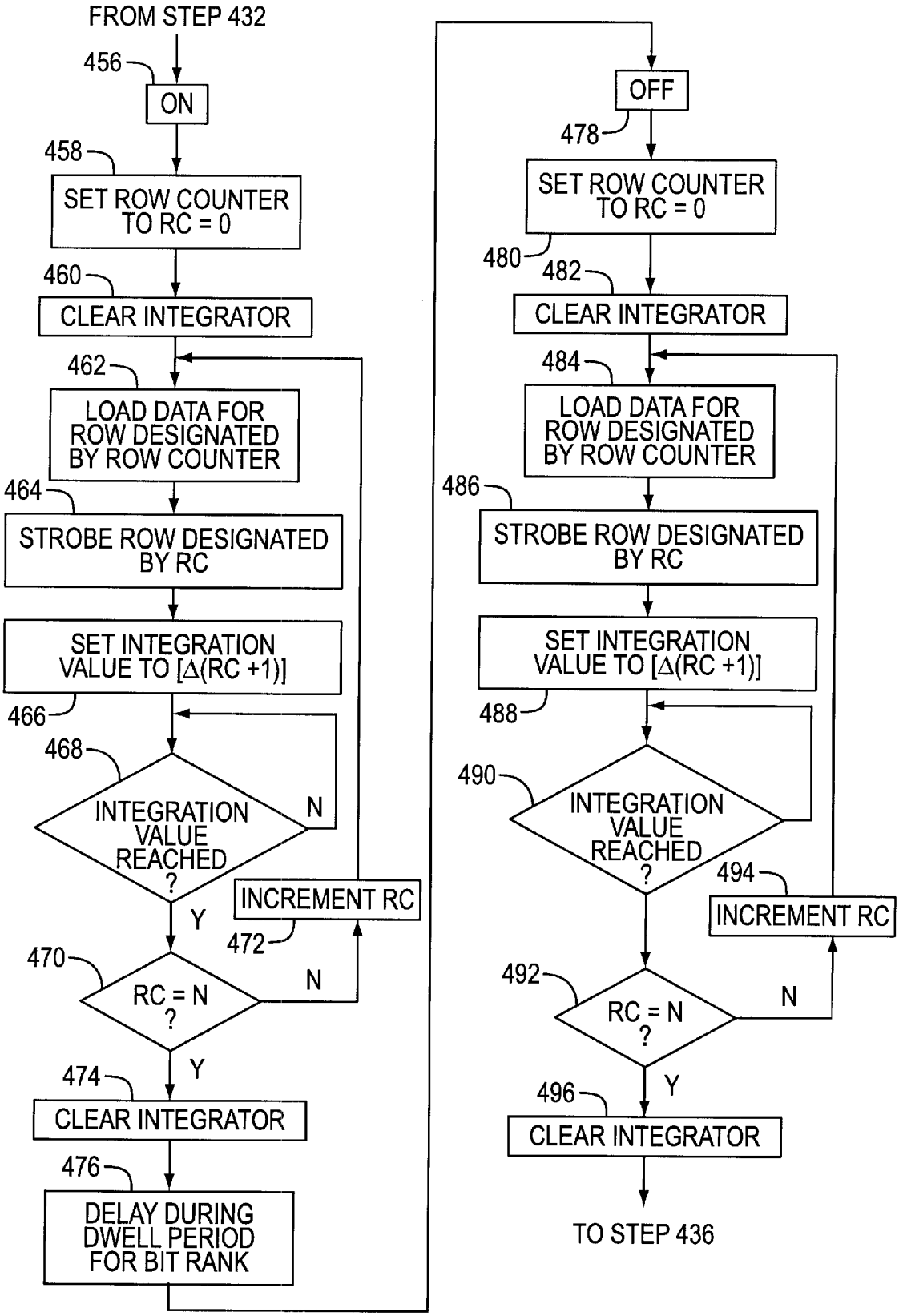
FIG. 13B is a flow chart illustrating one of the steps in FIG. 13A in more detail.

Step 434 for displaying the data of the bit rank is shown in more detail in FIG. 13B. In this FIG., ON source 374 is selected in step 456 by closing switch 376. A row counter (not illustrated) in control unit 336 is set to zero, meaning the first or top row of LCD 346, in step 458. Control unit 336 clears integrator 412 to zero in step 460. Data from the bit rank of the selected memory that is designated by the bit rank counter, and the row of that bit rank that is designated by the row counter, is loaded into shift register 360 in step 462. Then control unit 336 causes row selector 380 to strobe the row switch (382–386) that is designated by the bit row counter (step 464). Control unit 336 then transmits a light-level integration value to light-level register 414 in step 466. It determines this integration value by multiplying a predetermined integration increment Δ by the number of the row designated by the row counter plus one. The light-level integration value after the first row (row number zero) has been strobed is thus one times the integration increment Δ; after the second row (row number one) has been strobed, it is two times the integration increment Δ, and after the last row has been strobed (if LCD 352 has N rows, the last one would be row number N-1), it is NΔ.

In step 468, a check is made to determine whether the measured integration value from integrator 412 has reached the light-level integration value stored in register 414. After the integration value has been reached, a check is made at step 470 to determine whether the current content of the row counter is N. Since the last row of LCD 346 is designated as row N-i, the decision at step 470 will be no unless the last row of data has already been displayed. If the last row has not been displayed, the row counter is incremented at step 472 and the program returns to step 462.

If the content of the row counter has reached N at step 470, integrator 412 is cleared to zero in step 474. A delay period that is appropriate for the bit rank designated by the bit rank counter then follows in step 476. When the designated bit rank is zero, meaning the least significant bits, the delay during step 476 is zero, as indicated by FIG. 12. From FIG. 12, it will be apparent that the turn-on period (upward arrow), together with the turn-off period (downward arrow) for the least significant bits permit passage of the smallest quantized value of light through the LCD 346, as is appropriate for the least significant bits. Consider the top row of LCD 346; half of the smallest quantized amount passes through the top row during the turn-on period, and the top row is the first to be turned off during the turn-off period. The total amount of light provided to the top row during the period when it is on is thus equal to the integration increment Δ times the number N of rows. This same quantity of light is also provided to the second row during the period while it is on, to the third row, and so forth. To double the amount of light that was provided to each row of LCD 346 during the period when that row was on, the dwell period for LSB+1 must thus be such that each row receives an amount of light equal to an additional ΔN during the dwell period. Since all of the rows are on simultaneously during the dwell period, the actual time is approximately the same as the turn-on period or the turn-off period, unless the light intensity varies considerably.

Thus, when the bit rank is one, the dwell period of step 472 is provided by loading a light-level integration value that is equal to N times the integration increment Δ into light-level register 414. Similarly, for LSB+2, the total quantized amount of light provided to the rows of LCD 346 while they are on should be equal to four times the total amount of light that was provided to the rows while they were on during the display of the least significant bit. This means that the light-level integration value loaded into register 414 in step 476 when the content of the bit rank counter is 2 is equal to 3 ΔN. From FIG. 12, it will be apparent that the dwell period for LSB+3 is zero; the dwell period for LSB+4 is provided by loading ΔN into light-level register 414; the delay period for LSB +5 is provided by loading 3ΔN into register 414; and the delay period for the most significant bit is provided by loading 7ΔN into register 414.

With continuing reference to FIG. 13B, switch 376 (FIG. 11) is opened to disconnect ON source 374 from line 368, and switch 372 is closed to connect OFF source 370 to line 368. This corresponds to off-step 478. Then the row counter in control unit 336 is set to zero in step 480, and integrator 412 is cleared in step 482. Then, from the selected bit rank of the selected memory, the row of data designed by the row counter RC is shifted into shift register 360 during step 484. The row that has just been loaded is strobed during step 486, and the appropriate light-level integration value is transferred to light-level register 414 during step 488. As was the case during the turn-on sequence, the light-level integration value is the product of the integration increment Δ and the content of the row counter plus 1. When the measured integration value provided by integrator 412 reaches the light-level integration value stored in register 414 (Y in step 490), a check is made at step 492 to determine whether the last row of LCD 346, row number N-1, has already been strobed (in which case the content of the row counter will be RC=N). If not, the row counter is incremented in step 494, and the process returns to step 484. If the content of the row counter is N, however, integrator 412 is cleared at step 496, and the process then proceeds to step 436 (FIG. 13A).

Returning now to FIG. 11, the ON source 374 and the OFF source 370 may simply be DC sources, which provide voltages of opposite polarity, call them "V-ON" and "V-OFF," that are sufficient for turning the liquid crystal cells on and off. A cell that is turned on by connecting it momentarily between ground and V-ON is later turned off by connecting it momentarily between ground and V-OFF. Since V-ON and V-OFF have opposite polarities, the cell is not subjected to long-term exposure to the same polarity, which would be injurious to the LCD.

The illumination unit 398 in FIG. 11 includes a plurality of fluorescent lamps for each primary color, the different colors being selected in sequence and the lamps for that color being driven at the same intensity. The intensity is controlled to change between a low level and a high level that is eight times larger. One way that lamp driver 394 can accomplish this is by controlling the duty cycle of the lamps of the selected color. For example, driver 394 would supply pulse-width modulated energy with a long pulse length for the high-level light output, and pulse-width modulated energy with a short pulse length for the low-level light output. In contrast to the illumination unit 398 of FIG. 11, the illumination unit 94 of FIG. 1 includes one lamp that inherently emits a low level of light and another lamp that can be turned on so that, together, the two lamps emit the high level of light.

In both FIGS. 1 and 11, the illumination units emit light at a low level or at a high level that is eight times larger than the low level. Additional levels could be added. For example, a low level, an intermediate level that is four times greater than the low level, and a high level that is sixteen times greater than the low level. It may be inconvenient to do this using lamps that inherently have different output levels, as in FIG. 1. However, in the arrangement of FIG. 11, it will be apparent that the light-intensity command delivered to register 392 could have more than one bit, and the light-intensity value specified by the command could be a binary value designated by these bits.

Another difference between FIGS. 1 and 11 is that color wheel 100 in FIG. 1 provides the sequence of colors, while the lamps with different colors are used in FIG. 11. It will be apparent that a color wheel could be used with white light to back-light the LCD 346 of FIG. 11, or lamps with different colors could be used to illuminate the DMD 46 of FIG. 1.

It will be understood that the above description of the present invention is susceptible to various modifications, changes, and adaptations, and the same are intended to be comprehended within the meaning and range of equivalents of the appended claims.

What I claim is:

1. A method for using an addressable spatial light modulator, comprising:

displaying data on the spatial light modulator;

shining light on the spatial light modulator;

integrating the light;

comparing an electrical signal representing the integrated light to a predetermined value; and changing at least some of the data displayed on the spatial light modulator in response to the electrical signal representing the integrated light reaching the predetermined value.

2. The method of claim 1, further comprising changing the intensity of the light shined on the spatial light modulator.

3. The method of claim 2, wherein the light is emitted by a lamp unit having a plurality of lamps, and the step of changing the intensity is conducted by repeatedly turning at least one of the lamps on and off.

4. The method of claim 3, wherein the data comprises video information for a sequence of frames having a frame repetition rate, and further comprising passing the light through a color wheel and rotating the color wheel at the frame repetition rate.

5. The method of claim 3, wherein the data comprises video information for a sequence of frames having a frame repetition rate, and further comprising passing the light through a color wheel and rotating the color wheel faster than the frame repetition rate.

6. The method of claim 5, wherein the video information for each frame comprises most significant bits for a red component, and wherein the color wheel is rotated through an angle greater than 360° when the most significant bits of the red component of the frame are displayed by the spatial light modulator.

7. The method of claim 5, wherein the video information for each frame comprises multi-bit video words for a red component, wherein a first number of bit ranks of the red component of the frame are displayed during one revolution of the color wheel and a second number of bit ranks of the red component of the frame are displayed during another revolution of the color wheel, the first number of bit ranks being at least one bit rank, and the second number of bit ranks being greater than the first number.

8. The method of claim 2, wherein the light is emitted by a lamp unit having at least one lamp, and the step of changing the intensity is conducted by driving the at least one lamp at different energy levels during a sequence of time periods, each at least one lamp being driven in unison during the time periods.

9. The method of claim 8, wherein the data comprises video information for a sequence of frames having a frame repetition rate, and further comprising passing the light through a color wheel and rotating the color wheel at the frame repetition rate.

10. The method of claim 8, wherein the data comprises video information for a sequence of frames having a frame repetition rate, and further comprising passing the light through a color wheel and rotating the color wheel faster than the frame repetition rate.

11. The method of claim 10, wherein the video information for each frame comprises most significant bits for a red component, and wherein the color wheel is rotated through an angle greater than 360° when the most significant bits of the red component of the frame are displayed by the spatial light modulator.

12. The method of claim 10, wherein the video information for each frame comprises multi-bit video words for a red component, wherein a first number of bit ranks of the red component of the frame are displayed during one revolution of the color wheel and a second number of bit ranks of the red component of the frame are displayed during another revolution of the color wheel, the first number of bit ranks being at least one bit rank, and the second number of bit ranks being greater than the first number.

13. The method of claim 2, wherein the step of changing the intensity of the light comprises passing the light through at least one optical attenuator.

14. The method of claim 13, wherein the step of changing the intensity of the light further comprises rotating the at least one optical attenuator.

15. The method of claim 1, wherein the data comprises video information for a sequence of frames, each frame having a sequence of rows, and wherein the step of changing at least some of the data displayed on the spatial light modulator comprises writing data for a new row into the spatial light modulator when the integrated light reaches the predetermined value, the spatial light modulator being updated with data row-by-row.

16. The method of claim 15, further comprising changing the intensity of the light shined on the spatial light modulator.

17. A method for using an addressable spatial light modulator to display a sequence of frames having a frame repetition rate, comprising:

displaying data on the spatial light modulator;

shining light on the spatial light modulator;

coloring the light with a color wheel;

rotating the color wheel faster than the frame repetition rate; and changing the intensity of the light shined on the spatial light modulator as the color wheel rotates.

18. The method of claim 17, further comprising integrating the light, and changing at least some of the data displayed on the spatial light modulator when the integrated light reaches a predetermined value.

19. The method of claim 17, wherein the data displayed on the spatial light modulator includes data that turns all of the pixels of the spatial light modulator off during at least one complete revolution during the display of each frame.

20. The method of claim 17, wherein the step of rotating the color wheel is conducted by rotating the color wheel substantially faster than four times the frame repetition rate.

21. A method for using an addressable spatial light modulator to display a sequence of frames having a frame repetition rate, comprising:

displaying data on the spatial light modulator;

shining light on the spatial light modulator;

coloring the light with a color wheel; and rotating the color wheel faster than the frame repetition rate, wherein each frame comprises multi-bit video words having most significant bits and least significant bits for a red component of the frame, wherein the color wheel is rotated through an angle greater than 360° when the most significant bits of the red component of the frame are displayed by the spatial light modulator, and wherein the color wheel is rotated through an angle of less than 360° when the least significant bits of the red component of the frame are displayed by the spatial light modulator.

22. The method of claim 21, wherein the data displayed on the spatial light modulator includes data that turns all of the pixels of the spatial light modulator off during at least one complete revolution during the display of each frame.

23. The method of claim 21, further comprising integrating the light, and changing at least some of the data displayed on the spatial light modulator when the integrated light reaches a predetermined value.

24. The method of claim 21, further comprising changing the intensity of the light shined on the spatial light modulator as the color wheel rotates.

25. The method of claim 21, wherein the step of rotating the color wheel is conducted by rotating the color wheel substantially faster than four times the frame repetition rate.

26. A method for using an addressable spatial light modulator to display a sequence of frames having a frame repetition rate, comprising:

displaying data on the spatial light modulator;

shining light on the spatial light modulator;

coloring the light with a color wheel; and rotating the color wheel faster than the frame repetition rate, wherein each frame comprises multi-bit video words for a red component of the frame, and wherein a first number of bit ranks of the red component of the frame are displayed during one revolution of the color wheel and a second number of bit ranks of the red component of the frame are displayed during another revolution of the color wheel, the first number of bit ranks being at least one bit rank and the second number of bit ranks being greater than the first number.

27. The method of claim 26, wherein the data displayed on the spatial light modulator includes data that turns all of the pixels of the spatial light modulator off during at least one complete revolution during the display of each frame.

28. The method of claim 26, further comprising integrating the light, and changing at least some of the data displayed on the spatial light modulator when the integrated light reaches a predetermined value.

29. The method of claim 26, wherein the step of rotating the color wheel is conducted by rotating the color wheel substantially faster than four times the frame repetition rate.

30. A method for using an addressable spatial light modulator, comprising:

displaying data on the spatial light modulator; shining light from a light source on the spatial light modulator to generate an image for an observer;

detecting light emitted by the light source with a detector; and changing at least some of the data displayed on the spatial light modulator in response to a signal from the detector.

31. The method of claim 30, further comprising changing the intensity of the light shined on the spatial light modulator.

32. The method of claim 31, further comprising coloring the light shined on the spatial light modulator using a rotating color wheel, wherein each frame comprises multi-bit video words having most significant bits and least significant bits for a red component of the frame, wherein the color wheel is rotated through an angle of greater than 360° when the most significant bits of the red component of the frame are displayed jib by the spatial light modulator, and wherein the color wheel is rotated through an angle of less than 360° when the least significant bits of the red component of the frame are displayed on the spatial light modulator.

33. The method of claim 30, further comprising coloring the light shined on the spatial light modulator using a color wheel, and rotating the color wheel faster than a frame repetition rate of the data to be displayed, wherein the data displayed on the spatial light modulator includes data that turns all of the pixels of the spatial light modulator off during at least one complete revolution of the color wheel during the display of each frame.

34. A method for using an addressable spatial light modulator to display a sequence of frames having a frame repetition rate, comprising:

displaying data on the spatial light modulator;

shining light from a light source on the spatial light modulator;

coloring the light with a color wheel; and rotating the color wheel substantially faster than four times the frame repetition rate.

35. The method of claim 34, wherein the data comprises video words for red, green, and blue components of an image, the video words having a predetermined number of bits, and wherein the step of rotating the color wheel is conducted by rotating the color wheel a number of times that is at least as large as the predetermined number during each frame.

36. The method of claim 35, wherein the data displayed on the spatial light modulator includes data that turns all of the pixels of the spatial light modulator off during at least one complete revolution during the display of each frame.

37. The method of claim 34, further comprising detecting light emitted by the light source with a detector, and changing at least some of the data displayed on the spatial light modulator in response to a signal from the detector.

38. The method of claim 37, further comprising integrating the signal from the detector, and wherein the step of changing at least some of the data displayed on the spatial light modulator is conducted when the integrated signal reaches a predetermined value.

39. The method of claim 34, further comprising changing the intensity of the light shined on the spatial light modulator as the color wheel rotates.

* * * * *

UNITED STATES PATENT AND TRADEMARK OFFICE

CERTIFICATE OF CORRECTION

PATENT NO. : 6,535,187 B1
APPLICATION NO. : 09/063364
DATED : March 18, 2003
INVENTOR(S) : Lawson A. Wood It is certified that error appears in the above-identified patent and that said Letters Patent is hereby corrected as shown below:

The following Figure 14 should be added to the drawings:

--

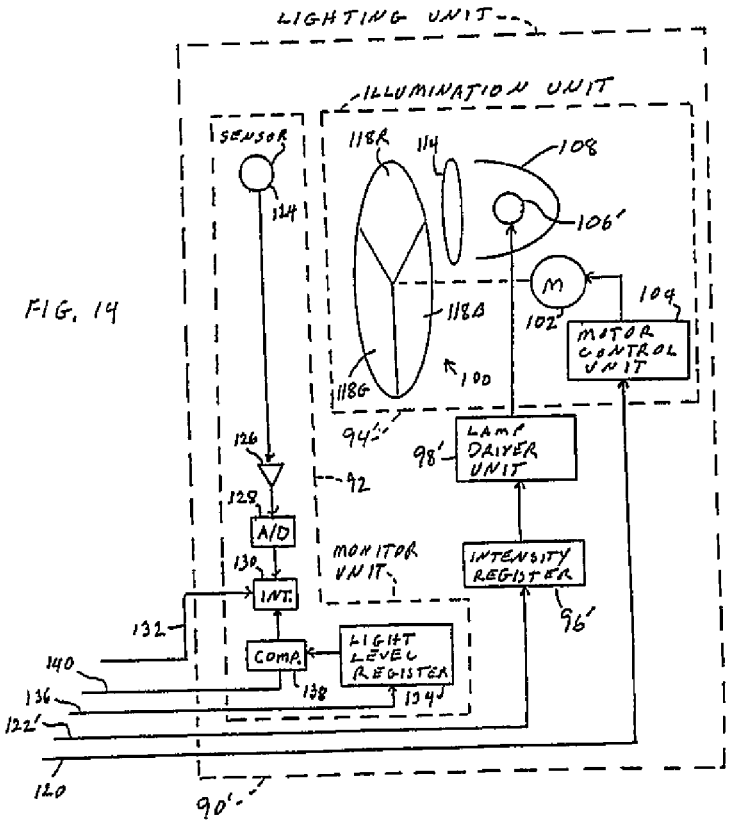

FIG. 14

--

Signed and Sealed this

Eleventh Day of December, 2007

JON W. DUDAS
*Director of the United States Patent and Trademark Office*